US012746958B2

(12) United States Patent
Hatakeyama et al.

(10) Patent No.: US 12,746,958 B2
(45) Date of Patent: Sep. 29, 2026

(54) INFORMATION PROCESSING DEVICE, INFORMATION PROCESSING METHOD, AND COMPUTER PROGRAM PRODUCT

(71) Applicant: KABUSHIKI KAISHA TOSHIBA, Tokyo (JP)

(72) Inventors: Ryoko Hatakeyama, Arakawa (JP); Tomoshi Otsuki, Kawasaki (JP)

(73) Assignee: KABUSHIKI KAISHA TOSHIBA, Tokyo (JP)

( * ) Notice: Subject to any disclaimer, the term of this patent is extended or adjusted under 35 U.S.C. 154(b) by 24 days.

(21) Appl. No.: 19/049,083

(22) Filed: Feb. 10, 2025

(65) Prior Publication Data

US 2025/0368242 A1 Dec. 4, 2025

(30) Foreign Application Priority Data

May 28, 2024 (JP) ..... 2024-086326

(51) Int. Cl.
*B61L 27/16* (2022.01)
*B61L 27/12* (2022.01)

(52) U.S. Cl.
CPC ..... *B61L 27/16* (2022.01); *B61L 27/12* (2022.01)

(58) Field of Classification Search
CPC ..... B61L 27/16; B61L 27/12; B61L 27/10
See application file for complete search history.

(56) References Cited

U.S. PATENT DOCUMENTS

2019/0359238 A1* 11/2019 Ding ..... G06F 3/0481
2025/0033681 A1* 1/2025 Chen ..... B61L 17/023

FOREIGN PATENT DOCUMENTS

| | | | |
|---|---|---|---|
| JP | 4241584 | B2 | 3/2009 |
| JP | 5449107 | B2 | 3/2014 |
| JP | 2023-101286 | A | 7/2023 |
| JP | 7414705 | B2 | 1/2024 |

* cited by examiner

*Primary Examiner* — Jacob M Amick
(74) *Attorney, Agent, or Firm* — Oblon, McClelland, Maier & Neustadt, L.L.P.

(57) ABSTRACT

An information processing device includes one or more hardware processors. The processors create, for each of moving bodies, a graph including nodes corresponding to the moving bodies, and edges representing a constraint on at least a part of an arrival-order, a departure-order, and an entry/exit method based on moving body information including the arrival-order representing an order in which the moving body arrives at a target area including stop sections allowing the moving body to stop, and the departure-order representing an order in which the moving body departs from the target area, and section information including an entry/exit method for entering each of the stop sections and exiting from each of the stop sections. The processors select an evaluation method used for evaluation of a graph among evaluation methods based on the section information. The processors evaluate the graph using the selected evaluation method.

27 Claims, 8 Drawing Sheets

FIG.2

121

| FORMATION | LOADING TIME | UNLOADING TIME |
|---|---|---|
| L1 | 22:15 | 6:00 |
| L2 | 22:30 | 5:45 |
| L3 | 23:30 | 5:15 |
| L4 | 22:45 | 5:00 |
| L5 | 23:00 | 6:15 |

FIG.3

122

| TRACK | ENTRY/EXIT METHOD |
|---|---|
| R1 | LIFO |
| R2 | FIFO |

INFORMATION PROCESSING DEVICE, INFORMATION PROCESSING METHOD, AND COMPUTER PROGRAM PRODUCT

CROSS-REFERENCE TO RELATED APPLICATIONS

This application is based upon and claims the benefit of priority from Japanese Patent Application No. 2024-086326, filed on May 28, 2024; the entire contents of which are incorporated herein by reference.

FIELD

Embodiments described herein relate generally to an information processing device, an information processing method, and a computer program product.

BACKGROUND

Many of rail depots and stations owned by railway operators have tracks for stopping (stabling) a plurality of formations (of railway cars/vehicles) in a column of the same line from the viewpoint of capacity. In such tracks, constraints (hereinafter, stabling constraints) are imposed on the entry/exit order of the formations. In a case where the stabling constraint is not satisfied, shunting of moving the formations that hinder the entry and exit to another track is required. The entry/exit order is determined by a plan created in advance (such as a vehicle operation plan). Because shunting requires human cost and time cost, it is desirable to create a plan that satisfies the stabling constraint as much as possible. In addition, at the time of creating a plan (specifically, for example, mixed integer linear programming), it is desirable that an optimal solution or a quasi-optimal solution that satisfies a stabling constraint can be searched more efficiently (for example, at high speed).

BRIEF DESCRIPTION OF THE DRAWINGS

FIG. 2 is a diagram illustrating an example of a data structure of moving body information;

FIG. 3 is a diagram illustrating an example of a data structure of section information;

DETAILED DESCRIPTION

Figure 1:
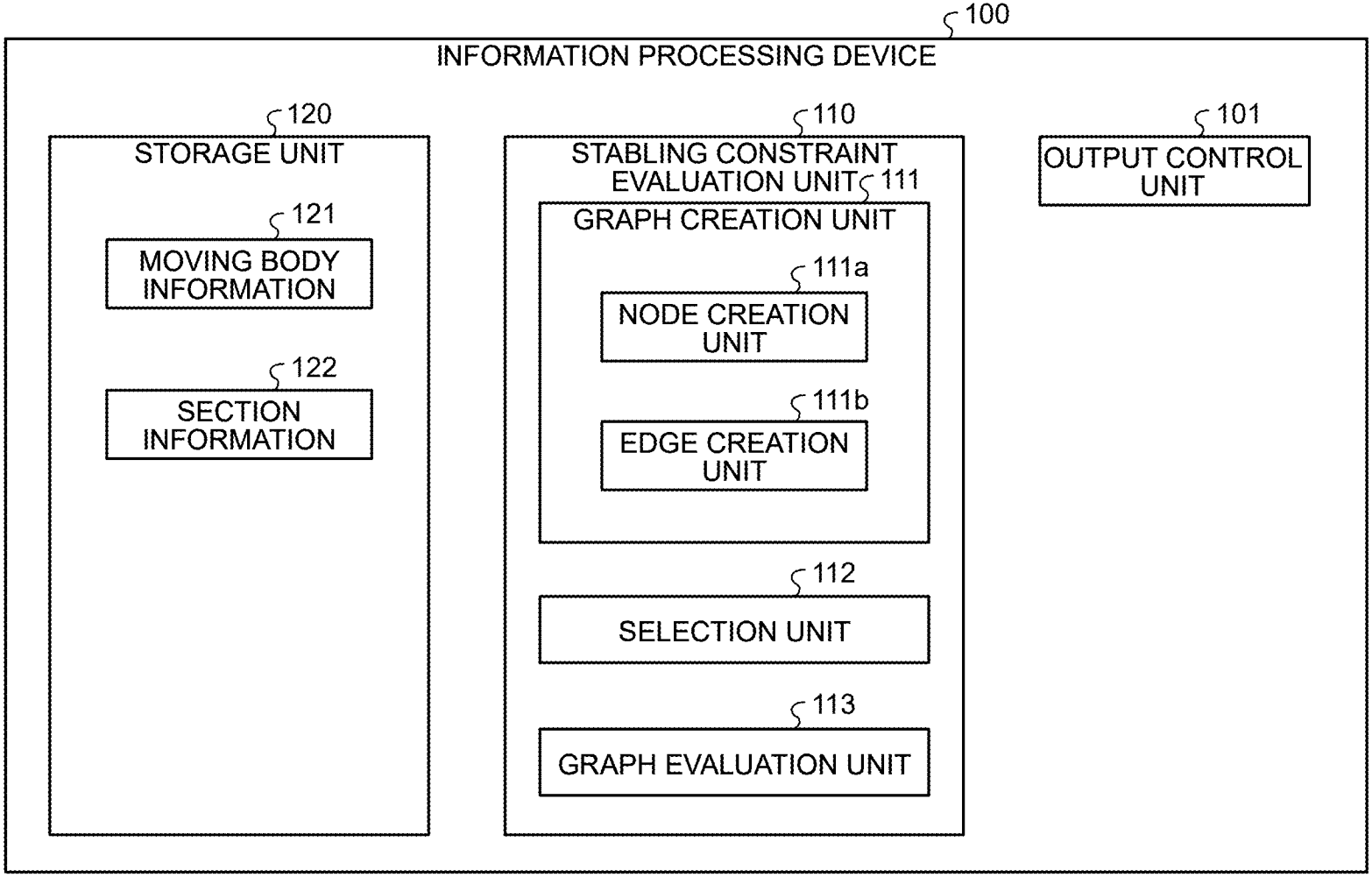
FIG. 1 is a block diagram of an information processing device according to a first embodiment.

According to an embodiment, an information processing device includes one or more hardware processors. The hardware processors are configured to create, for each of a plurality of moving bodies, a graph including a plurality of nodes corresponding to the plurality of moving bodies, and a plurality of edges representing a constraint on at least a part of an arrival order, a departure order, and an entry/exit method on a basis on moving body information including the arrival order representing an order in which a moving body arrives at a target area including a plurality of stop sections allowing the moving body to stop, and the departure order representing an order in which the moving body departs from the target area, and section information including the entry/exit method that is a method for entering each of the plurality of stop sections and exiting from the each of the plurality of stop sections. The hardware processors are configured to select, on a basis of the section information, an evaluation method to be used for evaluation of the graph from among a plurality of evaluation methods. The hardware processors are configured to evaluate the graph using the selected evaluation method.

Hereinafter, a preferred embodiment of an information processing device according to the present disclosure will be described in detail with reference to the accompanying drawings.

Hereinafter, an example of the moving body referring to a formation of railway cars (railway vehicles) will be mainly described. The moving body is not limited to the formation, and may be any other moving bodies such as a bus, a ship, a robot, an automatic guided vehicle (AGV), and a transportation equipment.

The meanings of terms used in the following description will be described.

Stabling: Stopping formation.

Track: A stop section allowing the formation to be stabled.

Target area: An area including a plurality of tracks. For example, a depot and a station correspond to the target area.

Stabling constraint: constraint on stabling for tracks.

Stabling plan: Plan of stabling the formation for tracks.

Operation: Operation from start to end of movement of one formation.

Vehicle operation plan: A plan for the operation of the formation, maintenance work, and stabling. The maintenance work is, for example, at least one of inspection and cleaning. The creation of the vehicle operation plan may include the creation of the stabling plan.

The operation can also be interpreted as corresponding to a schedule (operation schedule) obtained by dividing a train timetable defining a schedule of a plurality of formations in units of formations. The operations may include operations corresponding to all-day operation and operations corresponding to less than one day operation such as morning operation. A plurality of operations in less than one day can be combined and allocated to one formation as a daily operation. In the following embodiment, the operation is determined on a daily basis. For example, in a case where a plurality of operations for less than one day is allocated to one formation, the operations are collectively referred to as one operation. The unit of operation is not limited to one day, and the same procedure can be applied to any other unit. In the following embodiment, the operation also includes stabling a train without moving the formation in a depot or the like throughout the day.

When the formation enters each track of the target area, stops (is stabled), and thereafter exits, another formation that is stabled on the same track may become an obstacle to movement depending on the relationship between the time of entry and the time of exit. It is desirable that the stabling plan and the vehicle operation plan are created so as to be able to reduce shunning of moving the formation that becomes an obstacle as much as possible.

Hereinafter, entry may be referred to as loading or arrival, and exit may be referred to as unloading or departure. For example, the arrival time at which the formation arrives at the target area (track included in the target area) is also referred to as a loading time. The departure time at which the formation departs from the target area (track included in the target area) is also referred to as an unloading time. Hereinafter, the target area may be referred to as a place. For example, a target area for loading may be referred to as a loading place, and a target area for unloading may be referred to as an unloading place.

From the end of the operation to the start of the next day's operation, the formation is stabled in the track of the target area (depot, station, etc.). The creation of a stabling plan is to allocate a track to the formation. Shunting can be reduced by not allocating the formation that can be an obstacle to the same track. The creation of the vehicle operation plan is to determine operation of the formation, maintenance work, and shunting (stabling plan). Unless the timetable is disrupted, the formation is stabled according to the allocated loading time and unloading time of the operation. Therefore, the degree of suppression of shunting also depends on the vehicle operation plan.

As a technique for creating a stabling plan, for example, a technique for creating a stabling plan based on constraint logic programming (Comparative Example 1) has been proposed. The constraint logic programming is a general-purpose method for searching for a constraint satisfaction solution.

As a technique for creating the stabling plan and the vehicle operation plan, for example, a technique for creating the stabling plan and the vehicle operation plan based on mixed integer linear programming (Comparative Example 2) has been proposed. In such a technology, by considering the stabling constraint, it is possible to create a vehicle operation plan in which there is a stabling plan in which shunting is unnecessary as much as possible, and to simultaneously optimize the stabling plan and the vehicle operation plan. The mixed integer linear programming is a general-purpose method for searching for an optimal solution.

Since Comparative Example 1 and Comparative Example 2 use a general-purpose method, for example, it takes time to evaluate constraints, and it may be difficult to incorporate them into a heuristic method that requires large-scale problems and evaluation many times.

Each of the following embodiments makes it possible to more efficiently evaluate constraints used for creating a plan for a moving body. The information processing device of the first embodiment is a device (stabling constraint evaluation device) having a function of evaluating a stabling constraint (stabling constraint evaluation). The information processing device of the second embodiment is a device (stabling plan creation device) that creates a stabling plan based on the stabling constraint evaluation. The information processing device of the third embodiment is a device (vehicle operation plan creation device) that creates a vehicle operation plan (operation cycle serving as a base of the vehicle operation plan) by a heuristic method using the stabling constraint evaluation as one of the evaluation indexes.

First Embodiment

The information processing device (stabling constraint evaluation device) of the first embodiment creates a graph reflecting the relationship between the formations that hinder the movement, and evaluates the degree of suppression of shunting based on the created graph.

FIG. 1 is a block diagram illustrating an example of a configuration of an information processing device 100 according to the first embodiment. As illustrated in FIG. 1, the information processing device 100 includes a storage unit 120, a stabling constraint evaluation unit 110, and an output control unit 101.

The storage unit 120 stores various types of information used in the information processing device 100. For example, the storage unit 120 stores moving body information 121 and section information 122.

The moving body information 121 is information including at least an arrival order representing an order in which the formation arrives at the target area and a departure order representing an order in which the formation departs from the target area for each of the plurality of formations. The arrival order may be represented in any format as long as the order of arrival can be specified, and may be represented by, for example, an arrival time (loading time). Similarly, the departure order may be expressed in any form as long as the departure order can be specified, and may be expressed by, for example, the departure time (unloading time). Hereinafter, an example in which the arrival time and the departure time are used as the arrival order and the departure order will be mainly described. The moving body information 121 can also be interpreted as information that defines a schedule (operation schedule) for the operation for each of the plurality of formations.

FIG. 2 is a diagram illustrating an example of a data structure of the moving body information 121. As illustrated in FIG. 2, the moving body information 121 includes a formation, a loading time, and an unloading time. Identification information for identifying each formation is set in the formation field.

The moving body information 121 is not limited to the example of FIG. 2, and may further include other elements. For example, the moving body information 121 may include information indicative of the length of the formation. The information indicative of the length of the formation may be represented by the number of vehicles (the number of formation vehicles) included in the formation. In a case where a plurality of target areas are targets, the moving body information 121 may further include specifying information for specifying any of the plurality of target areas.

The section information 122 is information including at least an entry/exit method that is a method of entry to the track and exit from the track for each of the plurality of tracks.

FIG. 3 is a diagram illustrating an example of a data structure of the section information 122. As illustrated in FIG. 3, the section information 122 includes a track and an entry/exit method. Identification information for identifying each track is set in the track field. The entry/exit method indicates a method of entry to the track and an exit from the track.

The section information 122 is not limited to the example of FIG. 3, and may further include other elements. For example, the section information 122 may further include information indicative of the length of each of a plurality of tracks included in the target area. The information indicative of the length of the track may be represented by the number of formations that can be stabled in the track (the number of formations) or the number of vehicles that can be stabled in the track (the number of formation vehicles). Hereinafter, the track in which the number of formations that can be stabled is n is referred to as an n-column track.

The section information 122 may further include a minimum value (entry difference minimum value) of the difference in time of entry into the track and a minimum value (exit difference minimum value) of the difference in time of exit from the track. The section information 122 may further include information on a connection relationship of a plurality of tracks included in the target area. The connection relationship of the tracks may be information indicative of a track branch and a track merge.

Note that the storage unit 120 can be configured by any commonly used storage medium such as a flash memory, a memory card, a random access memory (RAM), a hard disk drive (HDD), and an optical disc.

Part or all of each data (moving body information 121, section information 122) stored in the storage unit 120 may be stored in physically different storage media, or may be stored in different storage areas of the physically same storage medium.

Here, an example of the entry/exit method will be described. The entry/exit method includes, for example, a last-in-first-out (LIFO) method, a first-in-first-out (FIFO) method, and a FREE method.

The LIFO method is a last-in-first-out method in which the formation that has entered last exits first. The LIFO method is applied to a track in which one of both ends of the track is an entrance and the other is a dead end. That is, in the LIFO method, the formation can enter from the entrance of the track, can exit from the entrance, and cannot enter or exit from the end opposite to the entrance.

The FIFO method is a first-in-first-out method in which a formation that has entered first exits first. The FIFO method is applied to a track (track of one-way traffic) in which one of both ends of the track is an entrance and the other is an exit. That is, in the FIFO method, the formation can enter from the entrance of the track, cannot exit from the entrance, can exit from the exit, and cannot enter from the exit.

The FREE method is a method that can be applied to tracks whose both ends can be entrance or exit. In the FREE system, the formation can enter and exit from an entrance EA that is one of both ends of the track, and can enter and exit from an entrance EB that is the other of both ends of the track.

The entry/exit method can also be interpreted as information (direction information) defining a direction in which the formation can enter the track and a direction in which the formation can exit from the track. Hereinafter, a case where the entry/exit method is either the LIFO method or the FIFO method will be mainly described.

The relationship of the order of loading/unloading the plurality of formations is determined by the entry/exit method. In a case where the loading time and the unloading time of the formation are contrary to the order relationship, another formation becomes an obstacle to movement, and thus, shunting of moving the other formation to another track is required.

For example, in the track of the LIFO method, the reverse order of the loading order is the unloading order. In the track of the FIFO method, the loading order and the unloading order are the same.

For example, in a case where one of the pair of formations is later in the loading time and earlier in the unloading time, the two formations included in the pair can be loaded and unloaded without any trouble on the track of the LIFO method. Such a pair is hereinafter referred to as a LIFO pair.

On the other hand, in a case where one of the pair of formations is later in the loading time and later in the unloading time, in the track of the LIFO system, the formation whose unloading time is later is stabled in front of the formation whose unloading time is earlier (in the direction toward the entrance). Therefore, in the case of the track of the LIFO system, the route of the rear formation toward the entrance is blocked by the front formation. Therefore, shunting of the front formation that becomes an obstacle is required. In the case of the track of the FIFO method, the two formations included in such a pair can be loaded and unloaded without any trouble. Such a pair is hereinafter referred to as a FIFO pair.

The loading and unloading of the plurality of formations in the reverse order is the same as the fact that any pair of formations included in the plurality of formations is a LIFO pair. For example, the fact that the loading and unloading of the two formations are in the reverse order and the fact that the two formations are LIFO pairs are the same. It is the same that the loading and unloading of three formations becomes the reverse order and that the three pairs, which are two formation sets selected from the three formations, are all LIFO pairs.

Similarly, loading and unloading the plurality of formations in the same order is the same as that any pair of formations included in the plurality of formations is a FIFO pair.

As described above, shunting requires human cost and time cost. As such, the combination of the formations in which the order of loading and unloading is contrary to the order determined from the entry/exit method is desirably not stabled on the same track. For example, it is desirable that the combination of formations in which any pair becomes a LIFO pair, is to be stabled in the track of the LIFO system.

The minimum number of interchangeability when the shunting from the order of loading and unloading to the order determined from the entry/exit method is represented by a product of interchangeability corresponds to the number of times of necessary shunting. Note that one shunting means that one formation is transferred to another track and then returned to the original track. For example, the number of FIFO pairs among the pairs included in the plurality of formations stabled in the track of the LIFO method corresponds to the number of times of shunting.

The description returns to FIG. 1. The stabling constraint evaluation unit 110 evaluates the stabling constraint. The stabling constraint evaluation unit 110 includes a graph creation unit 111, a selection unit 112, and a graph evaluation unit 113.

Based on the moving body information 121 and the section information 122, the graph creation unit 111 creates a graph reflecting a relationship between formations that hinder movement associated with stabling. For example, on the basis of the moving body information 121 and the section information, the graph creation unit 111 creates a graph including a plurality of nodes corresponding to a plurality of formations, and a plurality of edges representing constraints on at least a part of the loading time (arrival time), the unloading time (departure time), and the entry/exit method.

The constraint represented by the edge includes at least some of the following constraints.

- Constraint on difference in arrival time (arrival order) between a plurality of formations
- Constraint on difference in departure time (departure order) between a plurality of formations
- Constraint on whether entry/exit methods of a plurality of formations match The graph creation unit 111 includes a node creation unit 111*a* and an edge creation unit 111*b*.

The node creation unit 111*a* creates a node on the basis of the moving body information 121. For example, the node creation unit 111*a* creates the same number of nodes as the number of formations. In a case where there are target areas, the node creation unit 111*a* may create the same number of nodes as the number of formations to be loaded into and unloaded from the plurality of target areas. The node creation unit 111*a* may create, for each of the plurality of target areas, the same number of nodes as the number of formations to be loaded into and unloaded from the target area. The node creation unit 111*a* may create the same number of nodes as the number of formations to be loaded into and unloaded from one target area (such as the target area specified by the specifying information) among the plurality of target areas.

The node creation unit 111*a* may create a node to which a weight corresponding to the length of the formation is set. For example, the node creation unit 111*a* uses the moving body information 121 including the length of the formation to set the length of the corresponding formation (such as the number of formation vehicles) as a weight for each of the created nodes.

The edge creation unit 111*b* creates an edge between the plurality of nodes on the basis of the moving body information 121 and the section information 122. For example, the edge creation unit 111*b* creates an edge between nodes corresponding to a predetermined pair of the LIFO pair and the FIFO pair. Such an edge corresponds to an edge representing a constraint on whether the entry/exit methods of the plurality of formations match.

Which one of the LIFO pair and the FIFO pair an edge is to be created may be determined according to, for example, an evaluation method using a graph. For example, the evaluation method may include a method of evaluating a node having an edge as a target and a method of evaluating a node having no edge as a target. Therefore, a pair that can be evaluated more efficiently may be determined as a pair that creates an edge by an evaluation method that can be selected.

The edge creation unit 111*b* may create an edge according to other conditions. Examples of conditions will be described below.

- Condition that loading time difference is equal to or greater than entry difference minimum value (constraint on difference in arrival time among a plurality of formations, constraint indicating that difference in arrival time among a plurality of formations is equal to or greater than entry difference minimum value)
- Condition that the unloading time difference is equal to or greater than the exit difference minimum value (constraint on difference in departure time between plurality of formations, constraint indicating that difference in departure time between plurality of formations is equal to or greater than minimum value of advancement difference)
- Condition that the sum of the lengths of formations (such as the number of formation vehicles) is equal to or less than the length (such as the number of formation vehicles) of track (stop section)
- Condition that target areas are the same (constraint as to whether pieces of specifying information of a plurality of formations match)

The edge creation unit 111*b* may create a hyperedge in which three or more nodes are connected (hypergraph).

The edge creation unit 111*b* may create an edge to which a weight is set on the basis of at least one of the moving body information 121 and the section information 122. For example, the edge creation unit 111*b* may create an edge to which the following elements are set as weights. The edge creation unit 111*b* may create an edge to which a function using two or more elements of the following plurality of elements as arguments is set as a weight.

- Difference in arrival order among plurality of formations
- Difference in departure order among plurality of formations
- Difference between sum of lengths of a plurality of formations (such as the number of formation vehicles) and length of stop section (such as the number of formation vehicles)
- Difference between loading time difference and entry difference minimum value
- Difference between unloading time difference and exit difference minimum value For example, the edge creation unit 111*b* creates an edge to which a weighted sum of the loading time difference between the plurality of formations and a value obtained by multiplying the unloading time difference by "−1" is set as a weight. In a case where robustness against disruption of the timetable is emphasized, a weighting factor for the loading time difference may be set to a value (for example, the former is 2 and the latter is 1) larger than a weighting factor for a value obtained by multiplying the unloading time difference by "−1". The reason why "−1" is multiplied is that the larger the value, the smaller the contribution to the weight. The method of reducing the contribution is not limited to the method of multiplying "−1", and any other method may be used. For example, a method of calculating the reciprocal of the value may be used.

The graph creation unit 111 may create one graph for one or more target areas, or may create one graph for each of one or more target areas.

The selection unit 112 selects an evaluation method to be used for evaluation of the created graph among a plurality of evaluation methods on the basis of the section information 122. For example, the selection unit 112 selects an evaluation method determined according to the entry/exit method included in the section information 122 among the plurality of evaluation methods.

For example, in a case where each of the plurality of tracks included in the target area is the 2-column track of the LIFO method, shunting becomes unnecessary by allocating the LIFO pair to each track. Therefore, the degree of suppression of shunting can be evaluated by counting the number of LIFO pairs (hereinafter, the number of LIFO pairs) without overlapping the formations. In a case where the number of LIFO pairs is equal to or greater than the number of 2-column tracks, shunting is unnecessary. In a case where the number of LIFO pairs is less than the number of 2-column tracks, shunting for the number of times corresponding to the difference therebetween (the value obtained by subtracting the number of LIFO pairs from the number of 2-column tracks) is required.

Counting the number of LIFO pairs without overlapping formations corresponds to calculating the maximum matching number of graphs having edges between nodes corresponding to the LIFO pairs. Matching in graph theory is a set of edges that do not share nodes. The maximum matching is the largest set among the sets of edges that do not share a node. Edmonds Algorithm and the like are known as an algorithm of a problem for obtaining maximum matching (maximum matching problem). By using such an algorithm, the degree of suppression of shunting can be strictly evaluated at a high speed. Note that the evaluation method (algorithm) does not need to be able to calculate an exact solution, and may be a method of calculating an approximate solution.

For example, the selection unit 112 selects an evaluation method for calculating the maximum matching number by Edmonds Algorithm or the like as an evaluation method for the 2-column track of the LIFO method. Note that the algorithm for calculating the maximum matching number is not limited to Edmonds Algorithm, and any other algorithm may be used. In addition, although the LIFO method and the LIFO pair have been described as an example, the same procedure can be applied by replacing the LIFO method and the LIFO pair with the FIFO method and the FIFO pair, respectively. The same applies to the following description.

In a case where each of the plurality of tracks included in the target area is a 3-column track of the FIFO method, shunting becomes unnecessary by allocating three formations as a FIFO pair to each track regardless of which pair is taken. Therefore, the degree of suppression of shunting can be evaluated by obtaining the maximum number of triangular partial graphs in the graph having the edge between the nodes corresponding to the FIFO pair.

The problem of obtaining the maximum number of triangular partial graphs has been actively studied in fields such as network analysis, and an evaluation method for performing evaluation more efficiently (for example, at a high speed) can be selected using these findings. For example, the selection unit 112 selects an evaluation method for obtaining the maximum number of triangular partial graphs as an evaluation method for the 3-column track of the FIFO method. This evaluation method may be a method of obtaining the maximum number of triangular partial graphs under the condition that nodes may be shared. The reason is that creation of a plan is possible for selecting the partial graph so as not to share the node from the partial graph when the maximum number is obtained and allocating the partial graph to the 3-column track. That is, the maximum number of triangular partial graphs can be used to evaluate the degree of suppression of shunting.

A case where the number of formations that can be stabled in the track is generalized to n will be described. In the n-column track, shunting becomes unnecessary by allocating the n formations corresponding to the clique of n nodes on the graph. The clique is a partial graph having an edge (becoming a full graph) between all two nodes. The clique with two nodes is an edge, and the clique with three nodes is a triangular partial graph. In a case where n is 4 or more, for example, the degree of suppression of shunting can be evaluated by obtaining a clique (maximum clique) having the maximum number of nodes. This is because it is possible to create a plan so as to select n nodes so as to include the nodes of the maximum clique as much as possible and allocate the nodes to the n-column track. In a case where there is a plurality of column tracks in which n is 4 or more, for example, the degree of suppression of shunting can be evaluated by obtaining the minimum number of cliques covering the graph. This is because it is possible to create a plan by repeatedly selecting and allocating n nodes to the n-column track as many as the number of column tracks so as to be included in one clique among the cliques covering the graph and not to be included in other cliques, particularly a clique having the large number of nodes.

In the graph theory, various derived problems related to the clique, such as a problem of obtaining the clique with the maximum number of nodes (maximum clique problem) and a problem of covering the graph with as few cliques as possible (minimum clique covering problem), have been studied, and an evaluation method for performing evaluation more efficiently (for example, at a high speed) can be selected using these findings. That is, the selection unit 112 selects an evaluation method for obtaining the maximum clique included in the graph or an evaluation method for obtaining the clique covering the graph as the evaluation method for the n-column track.

The evaluation method may be a method of counting the number of pairs in which the sum of the weights of the edges is maximum and the formation does not overlap. For example, the evaluation method may be a method of selecting a LIFO pair having a loading time difference as large as possible and an unloading time difference as small as possible without overlapping the formation. The problem of finding matching that maximizes the sum of edge weights may be referred to as a maximum weight matching problem. The Edmonds Algorithm described above is also known as an algorithm of a maximum weight matching problem.

Note that the evaluation by the graph evaluation unit 113 is executed for each graph. For example, in a case where plural graphs are created for a plurality of target areas, evaluation is executed for each of the plurality of graphs. Therefore, the selection unit 112 selects an evaluation method for each graph. In addition, one target area may include tracks of a plurality of types of entry/exit methods (LIFO method and FIFO method) and tracks of a plurality of lengths (such as 2-column track and 3-column track). In such a case, the selection unit 112 selects an evaluation method corresponding to one type of entry/exit method according to the above procedure. The selection unit 112 selects an evaluation method corresponding to another type of entry/exit method for the partial graph left in the evaluation by the selected evaluation method according to the above procedure. The remaining partial graph is, for example, a partial graph excluding an edge included in the selected clique. The above procedure may be repeated by changing the selected clique.

The graph evaluation unit 113 evaluates the graph created by the graph creation unit 111 using the evaluation method selected by the selection unit 112. For example, the graph evaluation unit 113 evaluates the graph by obtaining the number of cliques to be one or more included in the graph. In a case where n is 2, the graph evaluation unit 113 evaluates the graph by calculating the maximum matching number. In a case where n is 3, the graph evaluation unit 113 evaluates the graph by calculating the maximum number of triangular partial graphs. In a case where n is 4 or more, the graph evaluation unit 113 evaluates the graph by obtaining the maximum number of cliques or the minimum number of cliques when the graph is covered.

The evaluation result by the graph evaluation unit 113 may be in any form, and is, for example, at least a part of the following information.

- The number of obtained cliques (maximum matching number, etc.)
- Information indicative of formation corresponding to a node included in one or more cliques when the number of cliques is determined The output control unit 101 controls the output of various types of information used in the information processing device 100. For example, the output control unit 101 outputs the evaluation result by the graph evaluation unit 113. The information output method may be any method, and for example, a method of displaying on a display device, a method of transmitting information to an external device via a network, and the like can be applied.

At least a part of each unit (stabling constraint evaluation unit 110, output control unit 101) may be realized by one or more processing units. Each of the above units is realized by, for example, one or a plurality of processors. For example, each of the above units may be realized by causing a processor such as a central processing unit (CPU) and a graphics processing unit (GPU) to execute a program, that is, by software. Each of the above units may be realized by a processor such as a dedicated integrated circuit (IC), that is, hardware. Each of the above units may be realized by using software and hardware in combination. In a case where plural processors are used, each processor may implement one of the units or two or more of the units.

The information processing device 100 may be physically configured by one device or may be physically configured by a plurality of devices. For example, the information processing device 100 may be constructed on a cloud environment. Furthermore, each unit in the information processing device 100 may be dispersedly provided in a plurality of devices.

Figure 4:
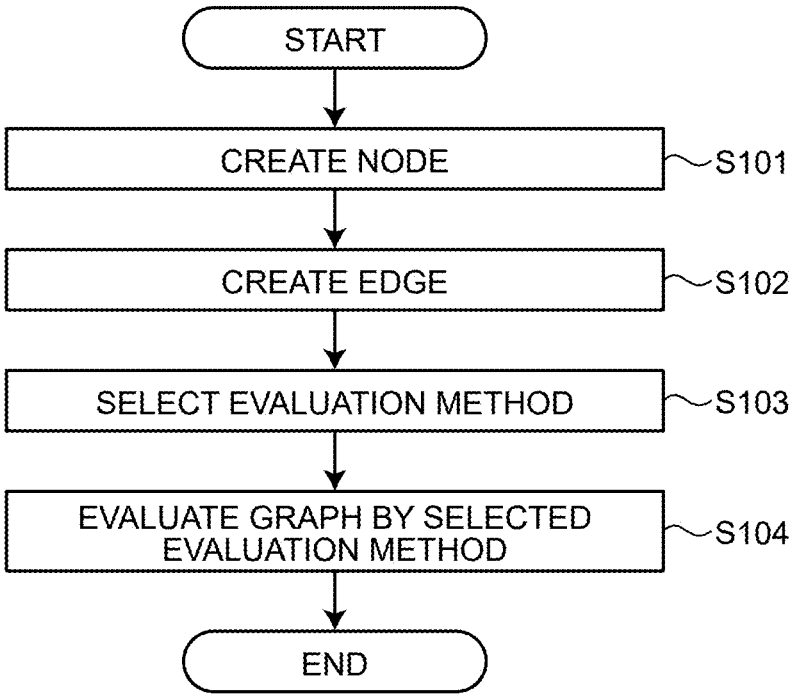
FIG. 4 is a flowchart of graph evaluation processing according to the first embodiment.

Next, graph evaluation processing by the information processing device 100 according to the first embodiment will be described. FIG. 4 is a flowchart illustrating an example of graph evaluation processing according to the first embodiment.

The node creation unit 111*a* of the graph creation unit 111 creates a node on the basis of the input moving body information 121 (Step S101). The node creation unit 111*a* may create a node in which the length of the formation is set as a weight.

The edge creation unit 111*b* of the graph creation unit 111 creates an edge between the plurality of nodes according to the condition (Step S102). The edge creation unit 111*b* may create an edge to which a weight is set.

The selection unit 112 selects an evaluation method to be used for evaluation of the created graph among a plurality of evaluation methods on the basis of the section information 122 (Step S103).

The graph evaluation unit 113 evaluates the graph created by the graph creation unit 111 using the evaluation method selected by the selection unit 112 (Step S104). The evaluation result by the graph evaluation unit 113 may be output by the output control unit 101.

Figure 5:
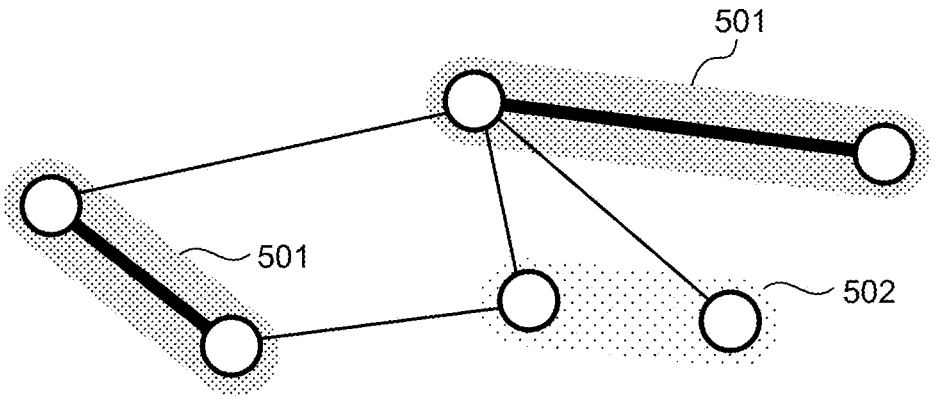
FIG. 5 is a diagram for explaining an example of an evaluation result.

FIG. 5 is a diagram for explaining an example of an evaluation result. The circles in the graph of FIG. 5 correspond to six nodes corresponding to six formations. A line connecting two nodes corresponds to an edge. For example, an edge is created between two nodes forming a LIFO pair.

A pair 501 of two nodes correspond to a pair (for example, LIFO pair) obtained by calculating the maximum matching number. The pair 501 does not need shunting. On the other hand, a pair 502 including the remaining nodes corresponds to a pair that requires shunting.

As described above, the information processing device of the first embodiment creates a graph reflecting the relationship between the formations that hinder the movement, and evaluates the degree of suppression of shunting based on the created graph. Even if the target number of formations involves a large scale problem, the degree of suppressing shunting as much as possible and the manner of stabling to suppress shunting as much as possible can be evaluated more efficiently (for example, at a higher speed).

Second Embodiment

An information processing device of a second embodiment creates a stabling plan on the basis of the stabling constraint evaluation by the method of the first embodiment.

Figure 6:
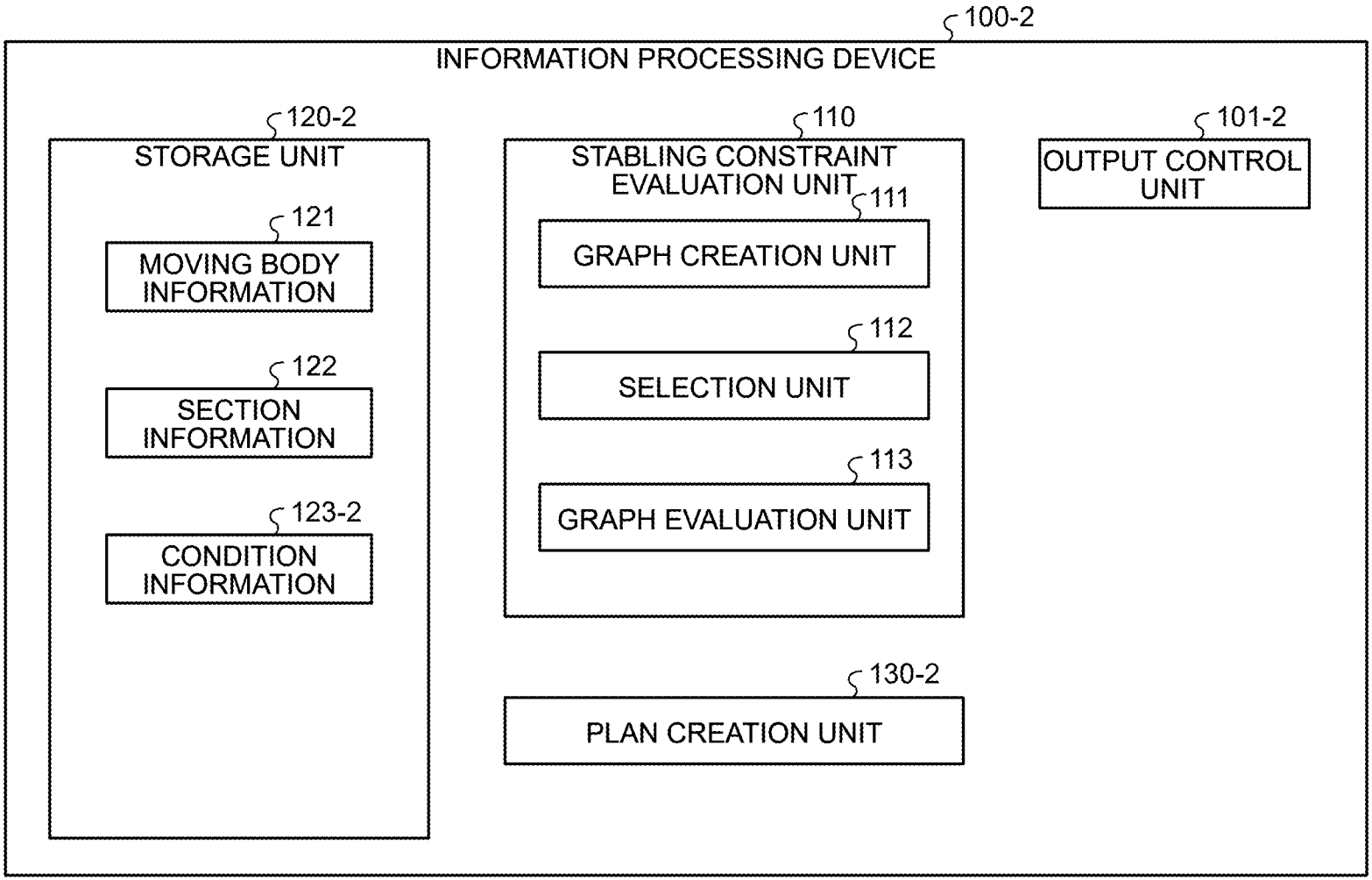
FIG. 6 is a block diagram of an information processing device according to a second embodiment.

FIG. 6 is a block diagram illustrating an example of a configuration of an information processing device 100-2 according to the second embodiment. As illustrated in FIG. 6, the information processing device 100-2 includes a storage unit 120-2, a stabling constraint evaluation unit 110, a plan creation unit 130-2, and an output control unit 101-2.

The second embodiment is different from the first embodiment in that functions of the storage unit 120-2 and the output control unit 101-2 and the plan creation unit 130-2 are added. Other configurations and functions are similar to those in FIG. 1 that is a block diagram of the information processing device 100 according to the first embodiment, and thus, are denoted by the same reference numerals, and description thereof is omitted here.

The storage unit 120-2 is different from the storage unit 120 of the first embodiment in that condition information 123-2 is further stored. The condition information 123-2 includes a condition used at the time of creating the stabling plan. The condition is, for example, a movement route of the attendant. The movement route of the attendant is, for example, a route on which the attendant moves from an attendant station (standby place) to the track.

The plan creation unit 130-2 and the plan creation unit 130-2 create a stabling plan on the basis of the evaluation result of the graph evaluation unit 113. For example, the plan creation unit 130-2 creates a stabling plan indicating that a plurality of formations corresponding to a plurality of nodes included in one or more cliques (edge, triangular partial graph, and the like) when the number of cliques is obtained is stopped in any one of the plurality of stop sections.

The plan creation unit 130-2 may create the stabling plan in consideration of the condition information 123-2. For example, the plan creation unit 130-2 creates a stabling plan indicating that a plurality of formations including a formation whose departure order is earlier are stopped in order from a stop section closer to the movement route of the attendant among the plurality of stop sections.

The output control unit 101-2 is different from the output control unit 101 of the first embodiment in further outputting information regarding the created stabling plan.

Hereinafter, description will be made assuming that the number of formation vehicles is the same in any formation, but the same procedure can be applied even if the number of formation vehicles is different depending on the formation. Furthermore, in the following description, it is assumed that the entry/exit method is the LIFO method for all tracks, but the same procedure can be applied to other entry/exit methods. In the following description, all tracks will be described as 1-column track or 2-column track, but the same procedure can be applied to tracks in which the number of formations that can be stabled is three or more.

The number of 2-column tracks is T2. The stabling plan is created by selecting pairs of T2 sets of formations without overlapping formations and allocating the pairs to 2-column track, and allocating the remaining formation to 1-column track without omission. At this time, the number of times of shunting can be reduced by selecting a LIFO pair as much as possible as a pair of formations allocated to the 2-column track. Furthermore, by selecting a pair of formations with the largest possible loading time difference, the increase in shunting can be suppressed even if the loading time difference slightly fluctuates, and it becomes robust against disruption of the timetable. By selecting a pair of formations having a smallest unloading time difference as much as possible and allocating a pair of formations having an earlier unloading time in order from a track close to the attendant station, the formation stabled on the movement route of the attendant from the station (station house) to the train to be served is preferentially unloaded, the time taken for the attendant to detour the formation is reduced, and the work efficiency is improved.

Figure 7:
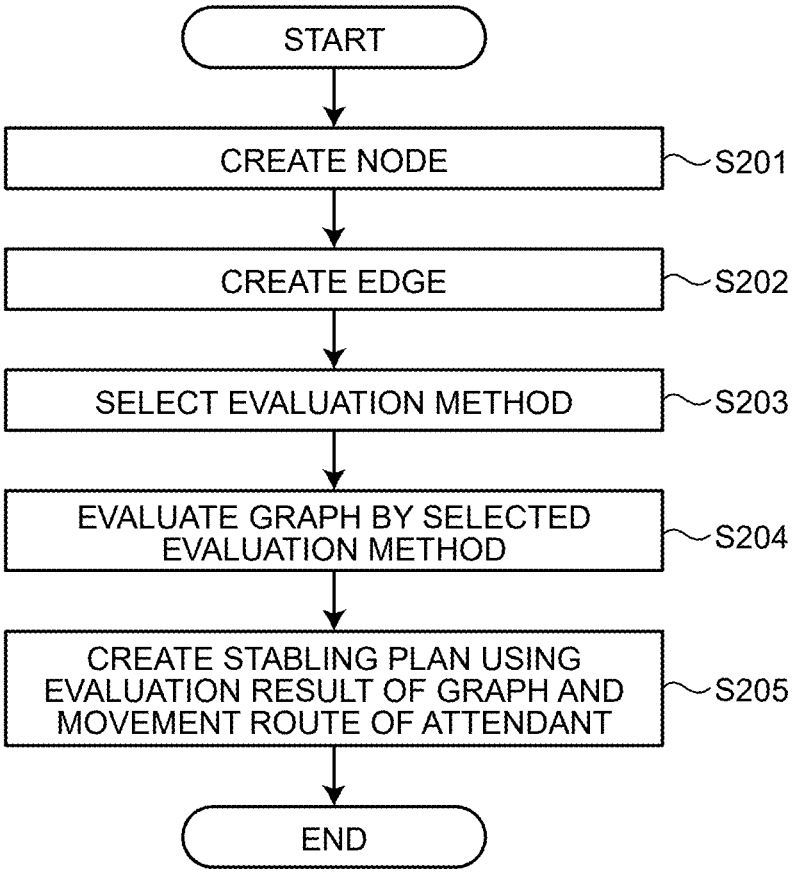
FIG. 7 is a flowchart illustrating an example of stabling plan creation processing in the second embodiment.

Next, the stabling plan creation processing by the information processing device 100-2 according to the second embodiment will be described with reference to FIG. 7. FIG. 7 is a flowchart illustrating an example of the stabling plan creation processing in the second embodiment.

Since Steps S201 to S204 are similar to Steps S101 to S104 in the information processing device 100 of the first embodiment, the description thereof will be omitted.

The plan creation unit 130-2 creates the stabling plan using the evaluation result of the graph and the movement route of the attendant (Step S205).

A specific example of the stabling plan creation processing will be described.

In Step S203, the selection unit 112 selects an evaluation method for obtaining only T2 sets of LIFO pairs having as large a loading time difference as possible and a small unloading time difference without overlapping the formation, for example, as the pair of formations to be allocated to the 2-column track of the LIFO method. For example, the selection unit 112 selects Edmonds Algorithm, which is an algorithm of the maximum weight matching problem, as the evaluation method.

In Step S204, the graph evaluation unit 113 evaluates the created graph by applying the evaluation method selected by the selection unit 112. In Step S205, the plan creation unit 130-2 creates the stabling plan based on the evaluation result. It is assumed that T2' pieces of matching are obtained by the evaluation.

When T2'≥T2, the plan creation unit 130-2 selects T2 edges in order from the matching (edge) having a larger weight among the T2' pieces of matching (edges), and allocates a pair of formations corresponding to nodes at both ends of the edge to the 2-column track for each selected edge. At this time, the plan creation unit 130-2 allocates a pair to the 2-column track close to the attendant station in order from the pair of formations with the earlier unloading time. The plan creation unit 130-2 allocates the remaining formation to the 1-column track close to the attendant station in order from the formation with the earlier unloading time.

When T2'<T2, the plan creation unit 130-2 allocates the pair of formations corresponding to the T2' pieces of matching (edges) to the 2-column track close to the attendant station in the ascending order of the unloading time. The plan creation unit 130-2 appropriately creates a pair of sets (T2−T2') in which the unloading time is earlier than the remaining formation and the unloading time difference is equal to or greater than the exit difference minimum value. The plan creation unit 130-2 allocates the created pairs to the remaining 2-column tracks in the order of proximity to the attendant station. The plan creation unit 130-2 further allocates the remaining formation to the 1-column track close to the attendant station in order from the formation with the earlier unloading time. The necessary shunting at this time is (T2−T2') times.

As described above, it is possible to create a stabling plan that suppresses shunting as much as possible, is robust against disruption of the timetable, and further reduces the movement time of the attendant.

The output control unit 101-2 outputs information based on the stabling plan created by the plan creation unit 130-2. For example, the created stabling plan and the number of times of shunting are output.

As described above, in the second embodiment, even in the case of a large-scale problem in which the number of target formations is large, shunting can be suppressed as much as possible, and the stabling plan in consideration of the influence of the disruption of the timetable and the work efficiency of the attendant can be created more efficiently (for example, at a higher speed).

Third Embodiment

An information processing device of a third embodiment creates a vehicle operation plan by a heuristic method using the stabling constraint evaluation as one of the evaluation indexes.

Figure 8:
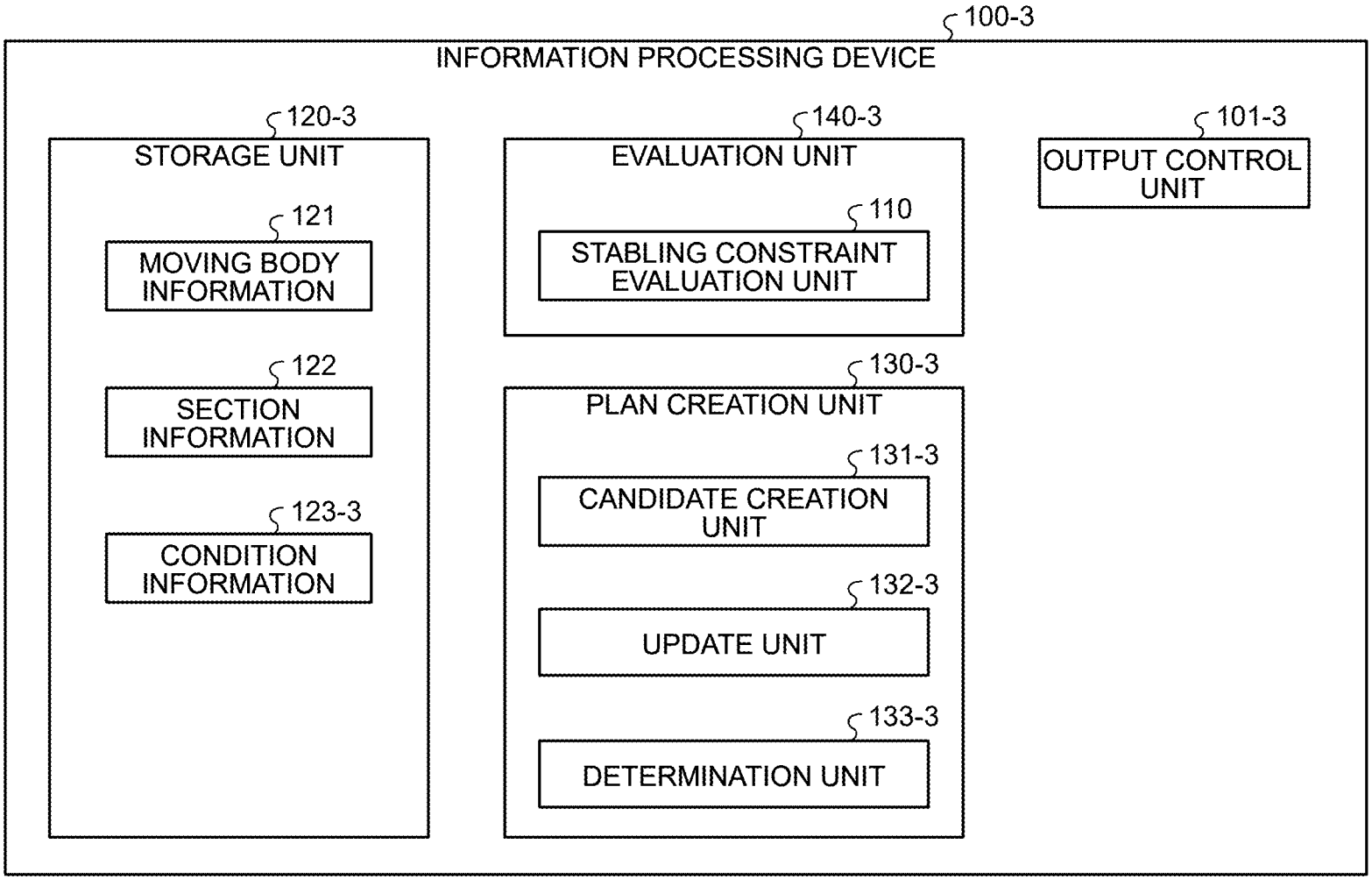
FIG. 8 is a block diagram of an information processing device according to a third embodiment.

FIG. 8 is a block diagram illustrating an example of a configuration of an information processing device 100-3 according to the third embodiment. As illustrated in FIG. 8, the information processing device 100-3 includes a storage unit 120-3, an evaluation unit 140-3, a plan creation unit 130-3, and an output control unit 101-3.

The third embodiment is different from the second embodiment in that functions of the storage unit 120-3, the plan creation unit 130-3, and the output control unit 101-3, and the evaluation unit 140-3 are added. Other configurations and functions are similar to those in FIG. 6 that is a block diagram of the information processing device 100-2 according to the second embodiment, and thus, are denoted by the same reference numerals, and description thereof is omitted here.

The storage unit 120-3 stores condition information 123-3 further including a condition used at the time of creating the vehicle operation plan. The conditions used at the time of creating the vehicle operation plan include, for example, at least a part of the following operation conditions.

- Target area and time zone in which maintenance work can be carried out
- Target value of the number of times of forwarding
- Legal cycle of maintenance work
- Target cycle of maintenance work.
- Target value of dispersion of maintenance work interval
- Target cycle of outside stabling
- Target value of dispersion of interval of outside stabling
- Target value of the number of combinations of formations that can be stabled in column track
- Weighting factor for type of formation operation (operation schedule)
- Weighting factor for switching of train timetable
- Weighting factor of evaluation value of vehicle operation plan The conditions used at the time of creating the vehicle operation plan may further include the following conditions.

- Information regarding update of candidate of vehicle operation plan (update condition)
- Information about end condition The term "outside stabling" means stabling in a target area (such as a station) where maintenance work cannot be performed. The operation cycle is an allocation pattern of an operation assigned to a formation.

The plan creation unit 130-3 creates a vehicle operation plan including the stabling plan. For example, the plan creation unit 130-3 creates a vehicle operation plan in the form of an operation cycle. In the present embodiment, the vehicle operation plan is created by changing the candidates of the operation cycle and evaluating the changed candidates (change candidates). The plan creation unit 130-3 includes a candidate creation unit 131-3, an update unit 132-3, and a determination unit 133-3.

The candidate creation unit 131-3 executes creation processing of a change candidate in which some of the candidates of the vehicle operation plans of the plurality of formations are changed. For example, the candidate creation unit 131-3 creates a change candidate by rearranging the order of some of the plurality of operations (operation schedules) included in the candidate. The candidate creation unit 131-3 may create a plurality of change candidates in which one candidate is changed.

The evaluation unit 140-3 executes calculation processing of an evaluation value indicative of a degree of satisfying one or more operation conditions for a plurality of formations for the created change candidate. The evaluation value includes the evaluation result of the graph. Therefore, the evaluation unit 140-3 includes a stabling constraint evaluation unit 110 that outputs the evaluation result of the graph and is similar to those of the first and second embodiments. As described later, the evaluation unit 140-3 may calculate one or more evaluation values including values other than the evaluation value corresponding to the evaluation result of the graph.

The update unit 132-3 executes update processing of updating the candidate with the change candidate in a case where the evaluation value calculated by the evaluation unit 140-3 satisfies the update condition.

The determination unit 133-3 determines whether an end condition representing a condition for ending repetition of the creation processing, the calculation processing, and the update processing is satisfied.

For example, the plan creation unit 130-3 repeatedly executes the creation processing, the calculation processing, and the update processing until the end condition is satisfied, and outputs a candidate obtained when the end condition is satisfied.

The output control unit 101-3 is different from the output control unit 101-2 of the second embodiment in that it outputs information regarding the created vehicle operation plan.

Details of the procedure for creating the vehicle operation plan will be further described. The vehicle operation plan is created by allocating operation, maintenance work, and stabling plans to a plurality of formations. Hereinafter, the conditions (operation conditions and the like) used at the time of creating the vehicle operation plan will be described in detail.

In many routes, a plurality of types of train timetables such as a weekday timetable, Saturday timetable, and a holiday timetable are used. That is, a plurality of different types of operation schedules may be determined depending on the day of the week or the like. In such a case, the plan creation unit 130-3 creates a vehicle operation plan so as to allocate different operations according to the type of train timetable.

A legal cycle may be set for the maintenance work, and it is desirable that the maintenance work is periodically performed. The maintenance work is performed only in the daytime at a depot, for example, and thus, a place (target area) and a time zone where the maintenance work can be performed are limited. Therefore, in the formation, whether the maintenance work can be performed by the allocated operation is determined.

For example, it is assumed that the required time of the maintenance work is 3 hours, and the maintenance work can be performed at the depot from 10:00 to 17:00. It is assumed that an operation OA that unloads the formation from the depot at 6:00 and loads the formation in the depot at 10:00 and an operation OB that unloads the formation from the depot at 16:00 and loads the formation in a station SA at 23:00 are allocated to a certain formation L1. The formation L1 is scheduled to be stabled in a time zone and a place (depot) where maintenance work can be performed for longer than a required time. As such, the maintenance work can be performed on the formation L1.

As described above, because the operation includes a spare vehicle that is stabled in a depot or the like throughout the day, the number of operations matches the number of formations. Therefore, the vehicle operation plan can be created by allocating one operation per day to any formation without omission and without duplication.

As described above, the operation is determined on a daily basis. Therefore, the unloading time and the unloading place of the operation are the time and place of unloading at the beginning of the day. The loading time and the loading place are the time and place of loading at the end of the day.

An example of the formation L1 will be described. In an operation OA' allocated on a daily basis to the formation L1, the unloading time and the unloading place are 6:00 and the depot, which are the unloading time and the unloading place of the operation OA. In addition, in the operation OA', the loading time and the loading place are 23:00 and the station SA that are the loading time and the loading place of the operation OB.

In a case where the loading place of the operation allocated to the formation is different from the unloading place of the operation allocated to the next day, it is necessary to perform the forwarding without passengers from the loading place to the unloading place. It is desirable to create a vehicle operation plan in which the loading place and the unloading place of continuous operation are matched as much as possible because human cost and time cost are required for the forwarding. The number of times the loading place and the unloading place do not match with each other is the number of times of forwarding.

An operation of stabling at a place where the maintenance work can be performed in a time zone in which the maintenance work can be performed for a required time or more is referred to as an operation in which the maintenance work can be performed. For example, the above-described operation OA' is an operation in which the maintenance work can be performed. Because the maintenance work needs to be periodically performed, it is desirable to create a vehicle operation plan in which operation that can be performed by the maintenance work is periodically allocated.

It is not desirable from the viewpoint of security that the outside stabling in which the maintenance work cannot be performed (such as a station) continues for consecutive days and the outside stabling is repeated at short intervals. The operation in which the loading place is a place where the maintenance work cannot be performed will be referred to as an operation in which the allocated formation is stabled outside because the allocated formation is stabled outside. For example, the operation OA' in which the loading place is the station SA is an operation for outside stabling. Therefore, it is desirable to create a vehicle operation plan in which the operation for outside stabling is allocated at equal intervals.

The degree of suppression of shunting depends on the loading order (arrival order) and the unloading order (departure order) of the formation to the target area (depot, station). Because the formation is loaded at the loading time of the operation allocated on the day and unloaded at the unloading time of the operation allocated on the next day, the degree of shunting associated with the stabling at night is determined by the vehicle operation plan. Accordingly, it is desirable to consider the stabling constraint at the stage of creating the vehicle operation plan.

In addition, if there are many stabling plans that suppress shunting to the same extent, it is possible to make a stabling plan again without causing an increase in shunting even when the timetable disruption or the like occurs. If the number of LIFO pairs is large, it is expected that there are many equivalent stabling plans. For example, when the formation L1 is a LIFO pair with both a formation L2 and a formation L3, shunting is not necessary even if either the pair of the formation L1 and the formation L2 or the pair of the formation L1 and the formation L3 is selected as the pair of formations to be stabled in the same track. It is assumed that, when a stabling plan in which the formation L1 and the formation L2 are allocated to the same track is selected, the formation L2 is delayed due to disruption of the timetable, and when the formation is stabled as planned, a shunting becomes necessary. At this time, by making a plan again so as to allocate the formation L3 instead of the formation L2 to the same track as the formation L1, shunting remains unnecessary.

The number of LIFO pairs is maximized when the ascending order of the loading time of the formation matches with the descending order of the unloading time. At this time, any formation pair becomes a LIFO pair. Assuming that the number of formations is N, the unloading order is N for the formation with the loading order of 1, the unloading order is (N−1) for the formation with the loading order of 2, and the unloading order is (N−2), and so on for the formation with the loading order of 3. That is, a value obtained by adding the loading order value and the unloading order value for all the formations is (1+N).

It is desirable that the vehicle operation plan is a plan that repeats the same pattern as much as possible from the viewpoint of preventing human error. Furthermore, because the formation has various conditions depending on the travel distance, it is desirable that the formation be used evenly.

As a technique for efficiently creating a vehicle operation plan satisfying these many conditions, a technique for creating a basic vehicle operation plan by creating an operation allocation pattern and allocating an operation by shifting this pattern by one day for each formation is used. Such a pattern corresponds to the operation cycle described above.

The operation cycle is information in which all operations included in a train timetable are arranged in a circle permutation. By allocating the operation to the formation according to the operation cycle, the operation of the formation is patterned, and a more easily understandable vehicle operation plan can be created. In addition, for any formation, all operations are equally allocated with the number of formations as a cycle, so that the travel distances of a plurality of formations are equalized.

Therefore, it is desirable that the operation cycle satisfies the condition of the vehicle operation plan. That is, it is desirable that the vehicle operation plan is created in consideration of matching between the loading place and the unloading place of the continuous operations, equalization of the operation intervals at which the maintenance work can be performed, equalization of the operation intervals of outside stabling, and the stabling constraint.

In addition, because the operation varies depending on the train timetable, an operation cycle is also created for each train timetable. When the vehicle operation plan is created, for example, the operation cycle of weekdays is allocated on weekdays, and the operation cycle of holidays is allocated on holidays. For example, it is assumed that the operation cycle on weekdays, Saturdays, and Sundays is defined as follows.

Operation cycle of weekdays: circle permutation of operation WD1, operation WD2, operation WD3, operation WD4, and so on Operation cycle of Saturdays: circle permutation of operation SD1, operation SD2, operation SD3, operation SD4, and so on Operation cycle of holidays: circle permutation of operation HD1, operation HD2, operation HD3, operation HD4, and so on Assuming that the operation allocated to a certain formation on Friday is the operation WD1, the operation is allocated according to the order in the permutation while switching the operation cycle according to the train timetable, such as the operation SD2 on Saturdays, the operation HD3 on Sundays, and the operation WD4 on Mondays. Therefore, it is desirable that the conditions of the vehicle operation plan are satisfied not only when each operation cycle independently satisfies, but also when a plurality of operation cycles are switched.

For example, it is desirable that the condition that the loading place and the unloading place of the continuous operation match with each other include not only the condition that the loading place of the operation WD1 on weekdays matches with the unloading place of the operation WD2 on weekdays, but also the condition that the loading place of the operation WD1 on weekdays matches with the unloading place of the operation SD2 on Saturdays. That is, it is desirable that the loading place and the unloading place of the continuous operation match with each other with respect to any switching of the operation cycle such as from weekdays to weekdays, from weekdays to holidays, from holidays to weekdays, and from holidays to holidays.

For example, it is assumed that the maintenance work condition is a condition for setting the target cycle of the maintenance work to once every two days. This condition desirably includes not only a condition that the operation WD3 on weekdays is an operation in which maintenance work can be performed when the operation WD1 on weekdays is an operation in which maintenance work can be performed, but also a condition that the operation HD3 on holidays is an operation in which maintenance work can be performed. That is, it is desirable that whether the maintenance work can be performed for the operation in the same order match between weekdays and holidays.

Similarly, when the stabling plan included in the vehicle operation plan is created, switching of a plurality of operation cycles is considered. For example, in order to evaluate the degree of suppression of shunting, it is desirable to consider not only the stabling constraint due to the input when the day after a weekday is a weekday but also the stabling constraint due to the input when the day after a weekday is Saturday as described below.

Input when the next day of a weekday is a weekday: the formation L1 in which the vehicle is loaded at the loading time of the operation WD1 on weekdays and is unloaded at the unloading time of the operation WD2 on weekdays, the formation L2 in which the vehicle is loaded at the loading time of the operation WD2 and is unloaded at the unloading time of the operation WD3, and the formation L3 in which the vehicle is loaded at the loading time of the operation WD3 and is unloaded at the unloading time of the operation WD4 on weekdays, and so on (omitted)

Input when the next day of a weekday is Saturday: the formation L1 to be loaded at the loading time of the operation WD1 on weekdays and unloaded at the unloading time of the operation SD2 on Saturdays, and so on (omitted)

That is, it is desirable to evaluate the stabling constraint for every switching of the operation cycle and to evaluate the operation cycle based on the evaluation value of the stabling constraint.

Furthermore, for the formations for which loading places differ cannot be stabled in the same track, the stabling constraint should be considered for each loading place. For example, when there is an operation of loading (further stabling) in the depot, the station SA, and the station SB, and there is a track (column track) for stabling a plurality of formations only in the depot and the station SA in a column, the stabling constraint is independently considered for each of the operation of loading the depot and the operation of loading in the station SA. In the operation of loading in the station SB having no column track, it is not necessary to consider the stabling constraint.

In the present embodiment, the information processing device 100-3 creates an operation cycle so as to satisfy various conditions of the vehicle operation plan as much as possible using a heuristic method based on a surround search.

Hereinafter, an example in which three operation cycles of weekdays, Saturdays, and holidays are simultaneously created based on three train timetables of a weekday timetable, a Saturday timetable, and a holiday timetable will be described. Even if the number of train timetables and operation cycles is other than three, the same procedure can be applied.

There are nine ways of switching the train timetable from weekdays to weekdays, from weekdays to Saturdays, from weekdays to holidays, from Saturdays to holidays, from Saturdays to weekdays, from Saturdays to Saturdays, from Saturdays to Saturdays, from Saturdays to holidays, from holidays to weekdays, from holidays to Saturdays, and from holidays to holidays. Hereinafter, a typical one week will be described as an example. In a typical one week, Monday to Friday fall into a weekday timetable, Saturday falls into a Saturday timetable, and Sunday falls into a holiday timetable.

The number of times each operation cycle is allocated in a typical one week is 5 on weekdays, 1 on Saturday, and 1 on holiday. In a typical one week, the number of times of switching of the operation cycle is four from a weekday to a weekday, one from a weekday to Saturday, one from Saturday to a holiday, one from a holiday to a weekday, and zero from the others.

Figure 9:
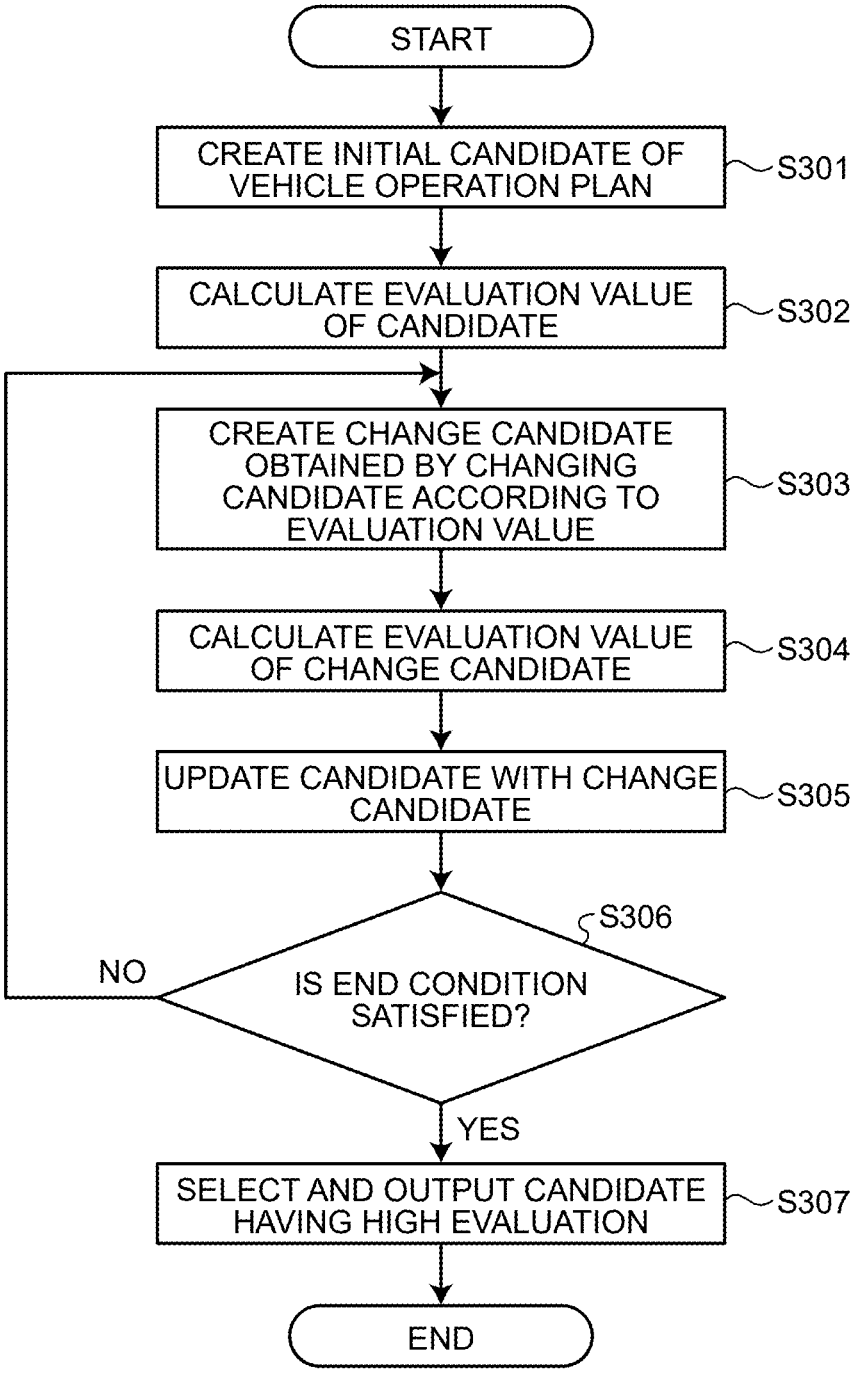
FIG. 9 is a flowchart of vehicle operation plan creation processing according to the third embodiment.

Next, vehicle operation plan creation processing by the information processing device 100-3 according to the third embodiment will be described with reference to FIG. 9. FIG. 9 is a flowchart illustrating an example of the vehicle operation plan creation processing according to the third embodiment.

The candidate creation unit 131-3 creates an initial candidate for the vehicle operation plan (operation cycle) (Step S301). The candidate creation unit 131-3 desirably creates an initial candidate at a higher speed. For example, the candidate creation unit 131-3 creates, as an initial candidate, an operation cycle in which the order of the plurality of operations is set so as to be the same order of loading and unloading as the loading order and the unloading order of the plurality of formations set in the moving body information 121 (corresponding to the plurality of operation schedules). The method of creating the initial candidate is not limited thereto, and any other method may be used. For example, the candidate creation unit 131-3 may create an initial candidate so as to satisfy the following conditions as much as possible.

The loading place and the unloading place of the continuous operation in the same operation cycle match with each other.

The loading place and the unloading place of the operation having the same order of different operation cycles are the same The candidate creation unit 131-3 creates three operation cycle candidates of weekdays, Saturdays, and holidays. For example, the candidate creation unit 131-3 sets the operation WD1 on weekdays as the first operation of the operation cycle on weekdays, sets the first operation of the operation cycle on Saturdays and holidays as the operation in which the loading place and the unloading place are the same as those of the operation WD1 as much as possible, and sets the loading place of the operation WD1 as the unloading place as much as possible in the second operation on weekdays. Thereafter, the candidate creation unit 131-3 sequentially determines the operation order in a similar manner.

The evaluation unit 140-3 calculates an evaluation value of the candidate (Step S302). Hereinafter, it is assumed that the smaller the evaluation value, the better the evaluation. For example, the evaluation unit 140-3 calculates one or more evaluation values based on each of one or more conditions of the vehicle operation plan, and sets the weighted sum of the one or more evaluation values as the evaluation value of the candidate for the operation cycle.

Hereinafter, six examples (evaluation values E1 to E6) of the evaluation value will be described. The evaluation unit 140-3 may use some of the following six evaluation values or may use evaluation values other than the following six evaluation values.

The evaluation value E1 corresponds to an evaluation value based on the condition that the loading place and the unloading place of the continuous operation match with each other. The evaluation value E1 is, for example, a weighted sum of the number of times the loading place and the unloading place of the continuous operation in each switching of the operation cycle do not match. For example, the weight for each switching is the number of occurrences of the switching in a typical one week.

The evaluation value E1 may be calculated in consideration of the target value of the number of times of forwarding. For example, when the number of times of forwarding is smaller than the target value, the weight is multiplied by ½. As a result, when the number of times of forwarding reaches the target value, evaluation can be performed with emphasis on other conditions.

The evaluation value E2 corresponds to an evaluation value based on a condition for equalization of operations under which maintenance work can be performed. The evaluation value E2 is, for example, a weighted sum of the number of times whether operations in which the order of different operation cycles is the same do not match whether maintenance work can be performed. There are three combinations of operation cycles, for example, weekdays and Saturdays, Saturdays and holidays, and holidays and weekdays. The weight for each combination is the number of times the combination occurs as switching in a typical one week. Each of weekdays, Saturdays, Saturdays, holidays, holidays, and weekdays is 1. The evaluation value E2 may be an evaluation value based on a difference in the number of operations in which maintenance work of different train timetables is possible.

The evaluation value E3 corresponds to an evaluation value based on equalization of operations in which maintenance work can be performed. The evaluation value E3 is, for example, a weighted sum of dispersion of operation intervals at which maintenance work can be performed in each operation cycle. The weight for each operation cycle is the number of allocation times of the operation cycle in a typical one week. The evaluation value E3 may be an evaluation value based on a target value of the dispersion of the maintenance work interval.

The evaluation value E4 corresponds to an evaluation value based on equalized operation of outside stabling. The evaluation value E4 is, for example, a weighted sum of the dispersion of the equalization intervals of the operation of outside stabling in each operation cycle. The weight for each operation cycle may be similar to the evaluation value E3. The evaluation value E4 may be an evaluation value based on the target value of the dispersion of the outside-stabling interval.

The evaluation value E5 corresponds to an evaluation value based on suppression of shunting. The evaluation value E5 is, for example, a value obtained by multiplying a weighted sum of the number of pairs of formations allocated to the 2-column track of the LIFO method in each switching of the operation cycle by "−1". The number of pairs is equal to the number of LIFO pairs counted without overlapping formations. The weight for each switching is, for example, the number of times of occurrence of the switching in a typical week.

The evaluation unit 140-3 first creates the formation corresponding to each switching. For example, it is assumed that the operation cycle on weekdays is an order of the operation WD1, the operation WD2, the operation WD3, the operation WD4, and so on. At this time, the formation for switching from weekdays to weekdays is as follows.

The formation L1 that is loaded at the loading time of the operation WD1 on weekdays and is unloaded at the unloading time of the operation WD2 on weekdays The formation L2 that is loaded at the loading time of the operation WD2 and is unloaded at the unloading time of the operation WD3

The formation L3 that is loaded at the loading time of the operation WD3 and is unloaded at the unloading time of the operation WD4

(hereinafter, omitted)

Next, the stabling constraint evaluation unit 110 calculates the number of LIFO pairs counted without overlapping formations for the formation corresponding to each switching. The stabling constraint evaluation unit 110 first creates a graph. For example, it is assumed that there is an operation of loading (further stabling) in a depot, a station SA, and a station SB, and only the depot and the station SA have two-column tracks of the LIFO system. At this time, the stabling constraint evaluation unit 110 creates a graph for each of the depot and the station SA.

The graph of the depot has nodes of the number of formations to be loaded in the depot and edges corresponding to LIFO pairs in the formations to be loaded in the depot. The same applies to the graph of the station SA. Next, the stabling constraint evaluation unit 110 selects an algorithm of the maximum matching problem, and calculates the maximum matching number by applying the selected algorithm to the graphs of the depot and the station SA.

The stabling constraint evaluation unit 110 sets the sum of the maximum matching number for the depot and the maximum matching number for the station SA as the number of pairs in switching as a target. The stabling constraint evaluation unit 110 calculates, as the evaluation value E5, a weighted sum obtained by weighting the number of times of occurrence of the switching in a typical one week with respect to the number of pairs in each switching.

The evaluation value E5 may be an evaluation value corresponding to the number of 2-column tracks (T2). For example, the stabling constraint evaluation unit 110 calculates different evaluation values E5 according to the magnitude relationship between the number of the 2-column tracks T2 and the number of pairs T2'.

For example, the stabling constraint evaluation unit 110 sets the evaluation value E5 to (T2-T2') when T2'≥T2, and sets the evaluation value E5 to M×(T2−T2') when T2'<T2. M is a real number greater than 1. (T2−T2') is the number of times of necessary shunting. Therefore, the candidates of the operation cycle requiring shunting are evaluated lower. The evaluation value E5 may be an evaluation value based on a target value of the number of combinations of formations that can be stabled in the 2-column track.

The evaluation value E6 corresponds to an evaluation value based on suppression of shunting. The evaluation value E6 is, for example, a value obtained by multiplying the weighted sum of the number of LIFO pairs in each switching of the operation cycle by "−1". The evaluation value E6 may be an evaluation value based on the target value of the LIFO pair.

Note that the evaluation value E5 corresponds to, for example, an evaluation value related to the maximum matching number or the like evaluated by the stabling constraint evaluation unit 110. On the other hand, the evaluation value E6 corresponds to an evaluation value related only to the number of LIFO pairs. When the number of LIFO pairs is large, there is a high possibility that a vehicle operation plan that satisfies an operation condition can be created by changing to another pair even if, for example, a disruption in the timetable occurs. The evaluation value E6 can be used to evaluate the candidate from such a viewpoint.

The evaluation unit 140-3 calculates a weighted sum of the evaluation values E1 to E6. The weight is determined, for example, based on the priority order of each condition. A higher priority may be set in the order of the evaluation values E1 to E6. For example, the weight may be determined according to the priority order such that the weight of the evaluation value E6 is 1, the weight of the evaluation value E5 is the maximum value that can be taken by the evaluation value E6, and the weight of the evaluation value E4 is the maximum value that can be taken by the evaluation value E5, and so on. As a result, it is possible to search for a candidate that satisfies a condition with a high priority as much as possible.

The weight may be changed by a search process. For example, the evaluation unit 140-3 sets the weight of the evaluation value other than the evaluation value E1 to 0 in the initial stage of the search, sets the weight to each of the six evaluation values as described above in the middle stage, and sets, in the latter stage, the weight having a smaller variation due to the evaluation value than in the middle stage. As a result, at the initial stage of search, only the condition with the highest priority can be considered, and the other conditions can be considered in a balanced manner as the search proceeds. That is, the candidates can be efficiently searched according to the priority order.

The description returns to FIG. 9. The candidate creation unit 131-3 creates one or more change candidates in which the candidates are changed by performing an operation of changing the candidates of the operation cycle (Step S303). Hereinafter, an example of change candidate creation processing will be described.

(Example 1) The candidate creation unit 131-3 creates a change candidate by, for example, causing an operation of exchanging two appropriately selected operations to act on the current candidate. It is assumed that candidates of the operation cycle on weekdays are the operation WD1, the operation WD2, the operation WD3, the operation WD4, and so on in this order. In a case where the operation WD1 and the operation WD3 are selected as the appropriate two operations, the change candidates of the operation cycle on weekdays are the operation WD3, the operation WD2, the operation WD1, the operation WD4, and so on. As a result, the violation of the condition of the vehicle operation plan can be resolved between the two exchanged operations and the operations before and after each of the two operations.

(Example 2) The candidate creation unit 131-3 extracts, for example, an operation included in the appropriate number of continuous sections, and creates a change candidate by causing an operation of inserting the extracted operation to act on the current candidate between two appropriate operations. It is assumed that the operation WD1 and the operation WD3 are selected as the operations to be the start point and the end point of the section to be extracted, and the position behind the operation WD4 is selected as the position to be inserted. In this case, the change candidates of the operation cycle on weekdays are the operation WD4, the operation WD1, the operation WD2, the operations WD3, and so on. As a result, the violation of the conditions of the vehicle operation plan can be resolved between the operation as the start point of the extracted section and the operation on the front side of the operation, and between the operation as the end point and the operation on the rear side of the operation.

(Example 3) The candidate creation unit 131-3 may associate operations in the same order with a plurality of operation cycles and create change candidates by applying the same operation to a plurality of corresponding operations. It is assumed that candidates of the operation cycle on Saturdays are in the order of the operation SD1, the operation SD2, the operation SD3, the operation SD4, and so on, and candidates of the operation cycle on holidays are in the order of the operation HD1, the operation HD2, the operation HD3, the operation HD4, and so on. For example, it is assumed that an operation of exchanging two appropriate operations simultaneously acts on three operation cycles. In addition, it is assumed that the operation WD1 and the operation WD3 on weekdays are selected as the appropriate two operations.

At this time, the candidate creation unit 131-3 exchanges the operation WD1 and the operation WD3 of the operation cycle on weekdays, exchanges the operation SD1 and the operation SD3 of the operation cycle on Saturdays corresponding to these operations, and exchanges the operation HD1 and the operation HD3 of the operation cycle on Sundays. Thus, the operation cycle on Saturdays is the operation SD3, the operation SD2, the operation SD1, the operation SD4, and so on, and the operation cycle on holidays is the operation HD3, the operation HD2, the operation HD1, the operation HD4, and so on.

(Example 4) For an example in which two appropriate operations are exchanged, two operations may be selected on the basis of the condition of the vehicle operation plan. That is, the candidate creation unit 131-3 may select two operations not satisfying the operation condition from a plurality of operations, and create a change candidate by switching the selected two operations. For example, the candidate creation unit 131-3 selects two operations from the operations related to the violation of the condition of the vehicle operation plan. The candidate creation unit 131-3 may select two operations according to an evaluation value of each operation based on the condition of the vehicle operation plan (a value obtained in the process of calculating the evaluation value by the evaluation unit 140-3).

For example, the candidate creation unit 131-3 may select two operations in descending order of contribution to the evaluation value E1. As described above, the evaluation value E1 is, for example, a weighted sum of the number of times the loading place and the unloading place of the continuous operation in each switching of the operation cycle do not match. For example, the evaluation value of the operation WD2 on weekdays is a value obtained by adding +4 if the unloading place does not match the loading place of the operation WD1 on weekdays, +1 if the unloading place does not match the loading place of the operation HD1 on Sundays, +4 if the loading place does not match the unloading place of the operation WD3 on weekdays, and +1 if the loading place does not match the unloading place of the operation SD3 on Saturdays. The candidate creation unit 131-3 similarly calculates evaluation values for other operations, and selects two operations with larger evaluation values.

(Example 5) The candidate creation unit 131-3 may select two operations for shunting according to the evaluation value based on the condition that shunting is suppressed. Such an evaluation value is, for example, an absolute value of a difference (difference DA) between (1+N) and a sum of the loading order and the unloading order of continuous operations in each switching of the operation cycle, or a value obtained by squaring the difference DA.

(Example 6) The candidate creation unit 131-3 may select two operations to be exchanged according to the probability distribution. For example, the candidate creation unit 131-3 selects two operations according to a uniform random number. The candidate creation unit 131-3 may evaluate each operation using the evaluation value of each operation based on the condition of the vehicle operation plan, and select two operations according to the probability distribution based on the evaluation result. For example, the candidate creation unit 131-3 selects two operations on the basis of a probability distribution in which the probability increases as the operation has a lower evaluation value. For example, the candidate creation unit 131-3 uses a probability distribution in which a value normalized by dividing the evaluation value of each operation by the sum of the evaluation values for each operation is set as a probability.

(Example 7) The candidate creation unit 131-3 may select the section (operation at the start point and operation at the end point) of the operation extracted in the above Example 2 and the position of the operation to be inserted on the basis of the condition of the vehicle operation plan.

For example, the candidate creation unit 131-3 calculates, as an evaluation value, the number of loading places and unloading places that do not match with each other only for the operation on the front side in each switching of the operation cycle, and selects the operation as the start point on the basis of the calculated evaluation value. For example, the evaluation value at the start point of the operation WD2 on weekdays is a value obtained by adding +4 if the unloading place does not match the loading place of the operation WD1 on weekdays and +1 if the unloading place does not match the loading place of the operation HD1 on Sundays. Similarly, the evaluation value of the operation as the end point is calculated only for the operation on the rear side. For example, the evaluation value of the end point of the operation WD2 on weekdays is a value obtained by adding +4 if the loading place does not match the unloading place of the operation WD3 on weekdays and +1 if the loading place does not match the unloading place of the operation SD3 on Saturdays.

The position of the operation to be inserted is selected on the basis of an evaluation value obtained by counting the number of loading places and unloading places that do not match with each other in each switching of the operation cycle. For example, the evaluation value of the position between the operation WD1 and the operation WD2 on weekdays is a value obtained by adding +4 if the loading place of the operation WD1 and the unloading place of the operation WD2 do not match, +1 if the loading place of the operation WD1 and the unloading place of the operation SD2 on Saturdays do not match, +1 if the loading place of the operation SD2 on Saturdays and the unloading place of the operation HD1 on Sundays do not match, and +1 if the loading place of the operation HD1 and the unloading place of the operation WD2 do not match. Similarly to the operation of exchanging two operations, the candidate creation unit 131-3 may select a section and a position of an operation having a large evaluation value, or may select a section and a position of an operation on the basis of a probability distribution obtained by normalizing the evaluation value.

(Example 8) The candidate creation unit 131-3 may create a change candidate by acting the operations described in each of the above examples a plurality of times, or may create a change candidate by acting a plurality of operations described in each of the above examples in combination.

(Example 9) The candidate creation unit 131-3 may change the operation of creating a candidate on the basis of a search history such as a history of evaluation values of candidates.

(Example 10) The candidate creation unit 131-3 may divide the evaluation value related to the switching to the same operation cycle and the evaluation value related to the switching to a different operation cycle, and change the operation on the basis of the evaluation value. For example, the candidate creation unit 131-3 may determine the type to be subjected to the creation processing on the basis of the evaluation value for each of the plurality of types of candidates of the operation cycle, and execute the creation processing for the determined type of candidate.

For example, it is assumed that evaluation based on an evaluation value regarding switching from weekdays to weekdays is high, and evaluation based on an evaluation value regarding switching from weekdays to Saturdays and holidays to weekdays is low. At this time, the candidate creation unit 131-3 does not operate a candidate of the operation cycle on weekdays (does not create the change candidate), and creates the change candidate by operating only the operation cycle on Saturdays and holidays. For example, it is assumed that the evaluation based on the evaluation value regarding switching from weekdays to Saturdays, Saturdays to holidays, and from holidays to weekdays is high, but the evaluation based on the evaluation value from weekdays to weekdays and from holidays to holidays is low. At this time, the candidate creation unit 131-3 creates each change candidate by causing the same operation to act on each of the three operation cycles by associating the operations of the three operation cycles in the same order.

The description returns to FIG. 9. The evaluation unit 140-3 calculates an evaluation value of the created conversion candidate (Step S304). The evaluation unit 140-3 calculates the evaluation value of the conversion candidate by the same method as in Step S302.

The update unit 132-3 updates the current candidate with the created change candidate (Step S305). For example, the update unit 132-3 determines whether to set the change candidate as a new candidate by using the update condition. The update condition is, for example, a condition indicating that the evaluation value of the change candidate is smaller than the evaluation value of the current candidate. The update unit 132-3 compares the evaluation value of the candidate (the evaluation value calculated in Step S302) with the evaluation value of the change candidate (the evaluation value calculated in Step S304), and if the evaluation value of the change candidate is smaller, the change candidate is set as a new candidate. When a plurality of change candidates are created, the update unit 132-3 may set a change candidate having the smallest evaluation value among the plurality of change candidates as a new candidate.

The determination unit 133-3 determines whether the end condition is satisfied (Step S306). The end condition may be any condition, and for example, the following conditions can be used.

- The execution time of the vehicle operation plan creation processing reaches the upper limit.
- The time when the candidate is not updated reaches the upper limit.
- The number of created candidates reaches the upper limit.
- The evaluation value of the candidate (change candidate) is equal to or less than the threshold.
- No forwarding is required (for example, the evaluation value E1 having the highest priority becomes 0).
- Condition obtained by combining some or all of the plurality of conditions including the above conditions: for example, a condition indicating that the number of candidates created after the evaluation value E1 does not change reaches the upper limit.

In a case where the end condition is not satisfied (Step S306: No), the process returns to Step S303, and the process is repeated. In a case where the end condition is satisfied (Step S306: Yes), the output control unit 101-3 selects a candidate having a high evaluation (small evaluation value) from the candidates created so far and outputs the selected candidate as a vehicle operation plan (Step S307), and ends the vehicle operation plan creation processing. The output control unit 101-3 may select a plurality of candidates. For example, the output control unit 101-3 may select a certain number (for example, 5) of candidates in a descending order of evaluation values.

The output control unit 101-3 may output at least part of the following information other than the vehicle operation plan (selected candidate).

- Evaluation value of selected candidate (evaluation values E1 to E6)
- The number of times of forwarding
- The number of times of shunting
- Propriety of LIFO pair with respect to switching of train timetable of each operation pair
- Pair of operations that can be stabled in 2-column track
- Change in evaluation value of candidate and the like
- Changes in the mean and dispersion, such as the evaluation value of the created candidate Note that the evaluation unit 140-3 may evaluate the stabling constraint using a method not using a graph (for example, a general-purpose evaluation method as in Comparative Example 1 and Comparative Example 2) instead of including the stabling constraint evaluation unit 110 of the first (second) embodiment using a graph. Even with such a configuration, the creation of the vehicle operation plan can be more efficiently executed by using the heuristic method (a method of searching for a changed candidate) as described above.

As described above, in the information processing device according to the third embodiment, even in a case where the number of target formations is large and the number of train timetables is large (for example, three or more), it is possible to more efficiently (for example, at a higher speed) create the vehicle operation plan that satisfies the condition. The condition is, for example, a condition that forwarding can be suppressed as much as possible, outside stabling and maintenance work can be performed as regularly as possible, shunting can be suppressed as much as possible, influence due to disruption of the timetable can be considered, and these conditions are satisfied as much as possible even before and after switching of the train timetable.

As described above, according to the first to third embodiments, it is possible to more efficiently evaluate constraints used for creating a plan for a moving body.

Figure 10:
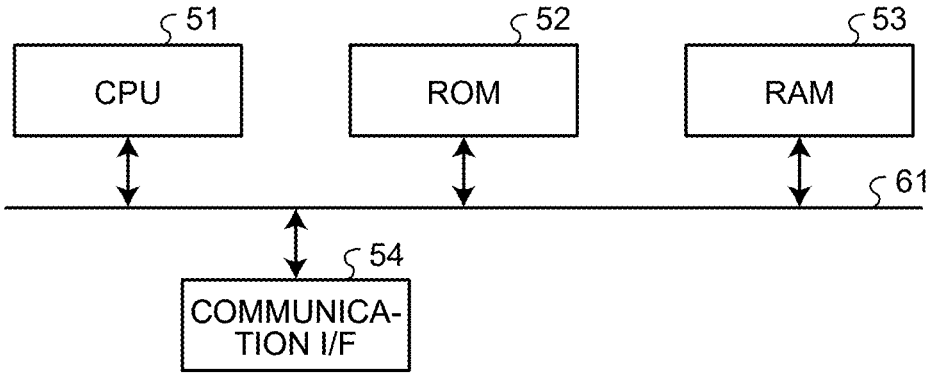
FIG. 10 is a hardware configuration diagram of the information processing device according to the first to third embodiments.

Next, a hardware configuration of the information processing device according to the first to third embodiments will be described with reference to FIG. 10. FIG. 10 is an explanatory diagram illustrating a hardware configuration example of the information processing device according to the first to third embodiments.

The information processing device according to the first to third embodiments includes a control device such as a central processing unit (CPU) 51, a storage device such as a read only memory (ROM) 52 and a random access memory (RAM) 53, a communication I/F 54 that is connected to a network and performs communication, and a bus 61 that connects the respective units.

The program executed by the information processing device according to the first to third embodiments is provided by being incorporated in the ROM 52 or the like in advance.

The program executed by the information processing device according to the first to third embodiments may be provided as a computer program product by being recorded as a file in an installable format or an executable format in a computer-readable recording medium such as a compact disk read only memory (CD-ROM), a flexible disk (FD), a compact disk recordable (CD-R), or a digital versatile disk (DVD).

Furthermore, the program executed by the information processing device according to the first to third embodiments may be stored on a computer connected to a network such as the Internet and provided by being downloaded via the network. In addition, the program executed by the information processing device according to the first to third embodiments may be provided or distributed via a network such as the Internet.

The program executed by the information processing device according to the first to third embodiments can cause a computer to function as each unit of the information processing device described above. In this computer, the CPU 51 can read a program from a computer-readable storage medium onto a main storage device and execute the program.

A configuration example of the embodiment will be described below.

Configuration Example 1. According to an embodiment, an information processing device includes one or more hardware processors. The hardware processors are configured to create, for each of a plurality of moving bodies, a graph including a plurality of nodes corresponding to the plurality of moving bodies, and a plurality of edges representing a constraint on at least a part of an arrival order, a departure order, and an entry/exit method on a basis on moving body information including the arrival order representing an order in which a moving body arrives at a target area including a plurality of stop sections allowing the moving body to stop, and the departure order representing an order in which the moving body departs from the target area, and section information including the entry/exit method that is a method for entering each of the plurality of stop sections and exiting from the each of the plurality of stop sections. The hardware processors are configured to select, on a basis of the section information, an evaluation method to be used for evaluation of the graph from among a plurality of evaluation methods. The hardware processors are configured to evaluate the graph using the selected evaluation method.

Configuration Example 2. In the information processing device according to configuration example 1, the moving body information further includes specifying information specifying one of a plurality of target areas for each of the plurality of moving bodies, The hardware processors are configured to create the graph including the plurality of nodes corresponding to the plurality of moving bodies arriving at the target area specified by the same specifying information or departing from the target area specified by the same specifying information.

Configuration Example 3. In the information processing device according to configuration example 1 or 2, the moving body information further includes a length of the moving body for each of the plurality of moving bodies. The hardware processors are configured to create the graph including a node to which a weight according to the length of the moving body is set.

Configuration Example 4. In the information processing device according to any one of configuration examples 1 to 3, the constraint includes at least a part of a constraint on a difference in the arrival order among the plurality of the moving bodies; a constraint on a difference in the departure order among the plurality of the moving bodies; and a constraint as to whether the entry/exit methods of the plurality of moving bodies match with each other.

Configuration Example 5. In the information processing device according to any one of configuration examples 1 to 4, the moving body information further includes a length of the moving body for each of the plurality of moving bodies. The section information further includes a length of the stop section for each of the plurality of stop sections. The constraint includes a constraint indicating that a sum of lengths of the plurality of moving bodies is equal to or less than a length of the stop section.

Configuration Example 6. In the information processing device according to any one of configuration examples 1 to 5, the moving body information further includes specifying information specifying one of a plurality of target areas for each of the plurality of moving bodies. The constraint includes a constraint as to whether the specifying information of the plurality of moving bodies matches.

Configuration Example 7. In the information processing device according to any one of configuration examples 1 to 6, the section information further includes, for each of the plurality of stop sections, an entry difference minimum value representing a minimum value of a difference in time of entry into the stop section and an exit difference minimum value representing a minimum value of a difference in time of exit from the stop section. The arrival order is based on an arrival time at which the moving body arrives at the target area. The departure order is based on a departure time at which the moving body departs from the target area. The constraint includes a constraint indicating that a difference in the arrival time among the plurality of moving bodies is equal to or greater than the entry difference minimum value, and a constraint indicating that a difference in the departure time among the plurality of moving bodies is equal to or greater than the exit difference minimum value.

Configuration Example 8. In the information processing device according to any one of configuration examples 1 to 7, the hardware processors are configured to create the graph including an edge to which a weight corresponding to at least one of a difference in the arrival order among the plurality of moving bodies and a difference in the departure order among the plurality of moving bodies is set.

Configuration Example 9. In the information processing device according to any one of configuration examples 1 to 8, the moving body information further includes a length of the moving body for each of the plurality of moving bodies. The section information further includes a length of the stop section for each of the plurality of stop sections. The hardware processors are configured to create a graph including an edge to which a weight corresponding to a difference between a sum of lengths of the plurality of moving bodies and the length of the stop section is set.

Configuration Example 10. In the information processing device according to any one of configuration examples 1 to 9, the section information further includes, for each of the plurality of stop sections, an entry difference minimum value representing a minimum value of a difference in time of entry into the stop section and an exit difference minimum value representing a minimum value of a difference in time of exit from the stop section. The arrival order is based on an arrival time at which the moving body arrives at the target area. The departure order is based on a departure time at which the moving body departs from the target area. The hardware processors are configured to create a graph including an edge to which a weight corresponding to at least one of a difference in the arrival time among the plurality of moving bodies and the entry difference minimum value and a difference in the departure time among the plurality of moving bodies and the exit difference minimum value is set.

Configuration Example 11. In the information processing device according to any one of configuration examples 1 to 10, the hardware processors are configured to select, from among the plurality of evaluation method, an evaluation method determined according to the entry/exit method included in the section information.

Configuration Example 12. In the information processing device according to any one of configuration examples 1 to 11, the hardware processors are configured to evaluate the graph by obtaining the number of cliques to be one or more included in the graph.

Configuration Example 13. In the information processing device according to configuration example 12, the hardware processors are configured to output an evaluation result that is at least a part of the number and the moving body corresponding to a node included in one or more of the cliques when the number is obtained.

Configuration Example 14. In the information processing device according to configuration example 12, the hardware processors are configured to create a stabling plan indicating that the plurality of moving bodies corresponding to a plurality of nodes included in one or more of the cliques when the number is obtained are stopped in any one of the plurality of stop sections.

Configuration Example 15. In the information processing device according to configuration example 14, the hardware processors are configured to create the stabling plan indicating that the plurality of moving bodies including the moving body of which the departure order is earlier are stopped in order from the stop section closer to a movement route of an attendant among the plurality of stop sections.

Configuration Example 16. In the information processing device according to any one of configuration examples 1 to 15, the hardware processors are configured to execute creation processing of a change candidate in which some of candidates for an operation plan of the plurality of moving bodies are changed; execute calculation processing of an evaluation value representing a degree of satisfying one or more operation conditions of the plurality of moving bodies with respect to the change candidate; execute update processing of the candidate with the change candidate in a case where the evaluation value satisfies an update condition; determine whether an end condition representing a condition for ending repetition of the creation processing, the calculation processing, and the update processing is satisfied; and repeatedly execute the creation processing, the calculation processing, and the update processing until the end condition is satisfied, and output the candidate obtained when the end condition is satisfied. The evaluation value includes an evaluation result of the graph.

According to an embodiment,

Configuration Example 17. According to an embodiment, an information processing method is executed by a computer of an information processing device. The method includes creating, for each of a plurality of moving bodies, a graph including a plurality of nodes corresponding to the plurality of moving bodies, and a plurality of edges representing a constraint on at least a part of an arrival order, a departure order, and an entry/exit method on a basis on moving body information including the arrival order representing an order in which a moving body arrives at a target area including a plurality of stop sections allowing the moving body to stop, and the departure order representing an order in which the moving body departs from the target area, and section information including an entry/exit method that is a method for entering each of the plurality of stop sections and exiting from the each of the plurality of stop sections; selecting, on a basis of the section information, an evaluation method to be used for evaluation of the graph from among a plurality of evaluation methods; and evaluating the graph using the selected evaluation method.

Configuration Example 18. According to an embodiment, a computer program product has a non-transitory computer readable medium including programmed instructions stored thereon. When executed by a computer, the instructions cause the computer to execute creating, for each of a plurality of moving bodies, a graph including a plurality of nodes corresponding to the plurality of moving bodies, and a plurality of edges representing a constraint on at least a part of an arrival order, a departure order, and an entry/exit method on a basis on moving body information including the arrival order representing an order in which a moving body arrives at a target area including a plurality of stop sections allowing the moving body to stop, and the departure order representing an order in which the moving body departs from the target area, and section information including an entry/exit method that is a method for entering each of the plurality of stop sections and exiting from the each of the plurality of stop sections; selecting, on a basis of the section information, an evaluation method to be used for evaluation of the graph from among a plurality of evaluation methods; and evaluating the graph using the selected evaluation method.

Configuration Example 19. According to an embodiment, an information processing device includes one or more hardware processors. The hardware processors are configured to execute creation processing of a change candidate in which some of candidates for an operation plan of a plurality of moving bodies are changed; execute calculation processing of an evaluation value representing a degree of satisfying one or more operation conditions of the plurality of moving bodies with respect to the change candidate; execute update processing of the candidate with the change candidate in a case where the evaluation value satisfies an update condition; determine whether an end condition representing a condition for ending repetition of the creation processing, the calculation processing, and the update processing is satisfied; and repeatedly execute the creation processing, the calculation processing, and the update processing until the end condition is satisfied, and output the candidate obtained when the end condition is satisfied.

Configuration Example 20. In the information processing device according to configuration example 19, the hardware processors are configured to create, for each of the plurality of moving bodies, a graph including a plurality of nodes corresponding to the plurality of moving bodies, and a plurality of edges representing a constraint on at least a part of an arrival order, a departure order, and an entry/exit method on a basis on moving body information including the arrival order representing an order in which a moving body arrives at a target area including a plurality of stop sections allowing the moving body to stop, and the departure order representing an order in which the moving body departs from the target area, and section information including an entry/exit method that is a method for entering each of the plurality of stop sections and exiting from the each of the plurality of stop sections; select, on a basis of the section information, the evaluation method to be used for evaluation of the graph from among a plurality of evaluation methods; and evaluate the graph using the selected evaluation method. The evaluation value includes an evaluation result of the graph.

Configuration Example 21. In the information processing device according to configuration example 19 or 20, the candidate includes a plurality of operation schedules each including an arrival order representing an order in which a moving body arrives at a target area including a plurality of stop sections in which the moving body can be stopped and a departure order representing an order in which the moving body departs from the target area. The hardware processors create the change candidate by exchanging an order of some of the plurality of operation schedules.

Configuration Example 22. In the information processing device according to configuration example 21, the hardware processors are configured to select two of the operation schedules not satisfying the operation condition from the plurality of operation schedules, and create the change candidate by exchanging the two selected operation schedules.

Configuration Example 23. In the information processing device according to configuration example 21, the hardware processors are configured to select two of the operation schedules using an evaluation value based on a difference between two of the operation schedules in which the arrival order is continuous and a difference between two of the operation schedules in which the departure order is continuous, and create the change candidate by exchanging two selected operation schedules.

Configuration Example 24. In the information processing device according to any one of configuration examples 19 to 23, the hardware processors are configured to change a method of changing some of the candidates on a basis of a history of the creation processing.

Configuration Example 25. In the information processing device according to any one of configuration examples 19 to 24, the hardware processors are configured to execute the creation processing on each of a plurality of types of the candidates.

Configuration Example 26. In the information processing device according to configuration example 25, each of the plurality of types of the candidates includes a plurality of operation schedules in which an order is determined. The hardware processors are configured to create the change candidate in which the operation schedule corresponding to an order included in each of the plurality of types of the candidates is changed.

Configuration Example 27. In the information processing device according to configuration example 25, the hardware processors are configured to determine a type to be a target of the creation processing on a basis of an evaluation value for each of the plurality of types of the candidates, and execute the creation processing on the candidate of the determined type.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An information processing device comprising one or more hardware processors configured to:

create, for each of a plurality of moving bodies, a graph including a plurality of nodes corresponding to the plurality of moving bodies, and a plurality of edges representing a constraint on at least a part of an arrival order, a departure order, and an entry/exit method on a basis on moving body information including the arrival order representing an order in which a moving body arrives at a target area including a plurality of stop sections allowing the moving body to stop, and the departure order representing an order in which the moving body departs from the target area, and section information including the entry/exit method that is a method for entering each of the plurality of stop sections and exiting from the each of the plurality of stop sections;

select, on a basis of the section information, an evaluation method to be used for evaluation of the graph from among a plurality of evaluation methods; and evaluate the graph using the selected evaluation method.

2. The information processing device according to claim 1, wherein the moving body information further includes specifying information specifying one of a plurality of target areas for each of the plurality of moving bodies; and the hardware processors are configured to:

create the graph including the plurality of nodes corresponding to the plurality of moving bodies arriving at the target area specified by the same specifying information or departing from the target area specified by the same specifying information.

3. The information processing device according to claim 1, wherein the moving body information further includes a length of the moving body for each of the plurality of moving bodies; and the hardware processors are configured to:

create the graph including a node to which a weight according to the length of the moving body is set.

4. The information processing device according to claim 1, wherein the constraint includes at least a part of:

a constraint on a difference in the arrival order among the plurality of the moving bodies;

a constraint on a difference in the departure order among the plurality of the moving bodies; and a constraint as to whether the entry/exit methods of the plurality of moving bodies match with each other.

5. The information processing device according to claim 1, wherein the moving body information further includes a length of the moving body for each of the plurality of moving bodies;

the section information further includes a length of the stop section for each of the plurality of stop sections; and the constraint includes a constraint indicating that a sum of lengths of the plurality of moving bodies is equal to or less than a length of the stop section.

6. The information processing device according to claim 1, wherein the moving body information further includes specifying information specifying one of a plurality of target areas for each of the plurality of moving bodies; and the constraint includes a constraint as to whether the specifying information of the plurality of moving bodies matches.

7. The information processing device according to claim 1, wherein the section information further includes, for each of the plurality of stop sections, an entry difference minimum value representing a minimum value of a difference in time of entry into the stop section and an exit difference minimum value representing a minimum value of a difference in time of exit from the stop section;

the arrival order is based on an arrival time at which the moving body arrives at the target area;

the departure order is based on a departure time at which the moving body departs from the target area; and the constraint includes a constraint indicating that a difference in the arrival time among the plurality of moving bodies is equal to or greater than the entry difference minimum value, and a constraint indicating that a difference in the departure time among the plurality of moving bodies is equal to or greater than the exit difference minimum value.

8. The information processing device according to claim 1, wherein the hardware processors are configured to:

create the graph including an edge to which a weight corresponding to at least one of a difference in the arrival order among the plurality of moving bodies and a difference in the departure order among the plurality of moving bodies is set.

9. The information processing device according to claim 1, wherein the moving body information further includes a length of the moving body for each of the plurality of moving bodies;

the section information further includes a length of the stop section for each of the plurality of stop sections; and the hardware processors are configured to create a graph including an edge to which a weight corresponding to a difference between a sum of lengths of the plurality of moving bodies and the length of the stop section is set.

10. The information processing device according to claim 1, wherein the section information further includes, for each of the plurality of stop sections, an entry difference minimum value representing a minimum value of a difference in time of entry into the stop section and an exit difference minimum value representing a minimum value of a difference in time of exit from the stop section;

the arrival order is based on an arrival time at which the moving body arrives at the target area;

the departure order is based on a departure time at which the moving body departs from the target area; and the hardware processors are configured to:

create a graph including an edge to which a weight corresponding to at least one of a difference in the arrival time among the plurality of moving bodies and the entry difference minimum value and a difference in the departure time among the plurality of moving bodies and the exit difference minimum value is set.

11. The information processing device according to claim 1, wherein the hardware processors are configured to:

select, from among the plurality of evaluation method, an evaluation method determined according to the entry/exit method included in the section information.

12. The information processing device according to claim 1, wherein the hardware processors are configured to evaluate the graph by obtaining a number of cliques to be one or more included in the graph.

13. The information processing device according to claim 12, wherein the hardware processors are configured to:

output an evaluation result that is at least a part of the number and the moving body corresponding to a node included in one or more of the cliques when the number is obtained.

14. The information processing device according to claim 12, wherein the hardware processors are configured to:

create a stabling plan indicating that the plurality of moving bodies corresponding to a plurality of nodes included in one or more of the cliques when the number is obtained are stopped in any one of the plurality of stop sections.

15. The information processing device according to claim 14, wherein the hardware processors are configured to:

create the stabling plan indicating that the plurality of moving bodies including the moving body of which the departure order is earlier are stopped in order from the stop section closer to a movement route of an attendant among the plurality of stop sections.

16. The information processing device according to claim 1, wherein the hardware processors are configured to:

execute creation processing of a change candidate in which some of candidates for an operation plan of the plurality of moving bodies are changed;

execute calculation processing of an evaluation value representing a degree of satisfying one or more operation conditions of the plurality of moving bodies with respect to the change candidate;

execute update processing of the candidate with the change candidate in a case where the evaluation value satisfies an update condition;

determine whether an end condition representing a condition for ending repetition of the creation processing, the calculation processing, and the update processing is satisfied; and repeatedly execute the creation processing, the calculation processing, and the update processing until the end condition is satisfied, and output the candidate obtained when the end condition is satisfied; and the evaluation value includes an evaluation result of the graph.

17. An information processing method executed by a computer of an information processing device, the method comprising:

creating, for each of a plurality of moving bodies, a graph including a plurality of nodes corresponding to the plurality of moving bodies, and a plurality of edges representing a constraint on at least a part of an arrival order, a departure order, and an entry/exit method on a basis on moving body information including the arrival order representing an order in which a moving body arrives at a target area including a plurality of stop sections allowing the moving body to stop, and the departure order representing an order in which the moving body departs from the target area, and section information including an entry/exit method that is a method for entering each of the plurality of stop sections and exiting from the each of the plurality of stop sections;

selecting, on a basis of the section information, an evaluation method to be used for evaluation of the graph from among a plurality of evaluation methods; and evaluating the graph using the selected evaluation method.

18. A computer program product having a non-transitory computer readable medium including programmed instructions stored thereon, wherein the instructions, when executed by a computer, cause the computer to execute:

creating, for each of a plurality of moving bodies, a graph including a plurality of nodes corresponding to the plurality of moving bodies, and a plurality of edges representing a constraint on at least a part of an arrival order, a departure order, and an entry/exit method on a basis on moving body information including the arrival order representing an order in which a moving body arrives at a target area including a plurality of stop sections allowing the moving body to stop, and the departure order representing an order in which the moving body departs from the target area, and section information including an entry/exit method that is a method for entering each of the plurality of stop sections and exiting from the each of the plurality of stop sections;

selecting, on a basis of the section information, an evaluation method to be used for evaluation of the graph from among a plurality of evaluation methods; and evaluating the graph using the selected evaluation method.

19. An information processing device, comprising one or more hardware processors, wherein the hardware processors are configured to:

execute creation processing of a change candidate in which some of candidates for an operation plan of a plurality of moving bodies are changed;

execute calculation processing of an evaluation value representing a degree of satisfying one or more operation conditions of the plurality of moving bodies with respect to the change candidate;

execute update processing of the candidate with the change candidate in a case where the evaluation value satisfies an update condition;

determine whether an end condition representing a condition for ending repetition of the creation processing, the calculation processing, and the update processing is satisfied; and repeatedly execute the creation processing, the calculation processing, and the update processing until the end condition is satisfied, and output the candidate obtained when the end condition is satisfied.

20. The information processing device according to claim 19, wherein the hardware processors are configured to:

create, for each of the plurality of moving bodies, a graph including a plurality of nodes corresponding to the plurality of moving bodies, and a plurality of edges representing a constraint on at least a part of an arrival order, a departure order, and an entry/exit method on a basis on moving body information including the arrival order representing an order in which a moving body arrives at a target area including a plurality of stop sections allowing the moving body to stop, and the departure order representing an order in which the moving body departs from the target area, and section information including an entry/exit method that is a method for entering each of the plurality of stop sections and exiting from the each of the plurality of stop sections;

select, on a basis of the section information, an evaluation method to be used for evaluation of the graph from among a plurality of evaluation methods; and evaluate the graph using the selected evaluation method; and the evaluation value includes an evaluation result of the graph.

21. The information processing device according to claim 19, wherein the candidate includes a plurality of operation schedules each including an arrival order representing an order in which a moving body arrives at a target area including a plurality of stop sections in which the moving body can be stopped and a departure order representing an order in which the moving body departs from the target area; and the hardware processors create the change candidate by exchanging an order of some of the plurality of operation schedules.

22. The information processing device according to claim 21, wherein the hardware processors are configured to:

select two of the operation schedules not satisfying the operation condition from the plurality of operation schedules, and create the change candidate by exchanging the two selected operation schedules.

23. The information processing device according to claim 21, wherein the hardware processors are configured to:

select two of the operation schedules using an evaluation value based on a difference between two of the operation schedules in which the arrival order is continuous and a difference between two of the operation schedules in which the departure order is continuous, and create the change candidate by exchanging two selected operation schedules.

24. The information processing device according to claim 19, wherein the hardware processors are configured to:

change a method of changing some of the candidates on a basis of a history of the creation processing.

25. The information processing device according to claim 19, wherein the hardware processors are configured to:

execute the creation processing on each of a plurality of types of the candidates.

26. The information processing device according to claim 25, wherein each of the plurality of types of the candidates includes a plurality of operation schedules in which an order is determined; and the hardware processors are configured to create the change candidate in which the operation schedule corresponding to an order included in each of the plurality of types of the candidates is changed.

27. The information processing device according to claim 25, wherein the hardware processors are configured to:

determine a type to be a target of the creation processing on a basis of an evaluation value for each of the plurality of types of the candidates, and execute the creation processing on the candidate of the determined type.

* * * * *